US007176851B2

(12) United States Patent
Shiokawa et al.

(10) Patent No.: US 7,176,851 B2
(45) Date of Patent: Feb. 13, 2007

(54) PANEL DISPLAY APPARATUS AND METHOD FOR DRIVING A GAS DISCHARGE PANEL

(75) Inventors: Akira Shiokawa, Osaka (JP); Ryuichi Murai, Toyonaka (JP); Yusuke Takada, Katano (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 509 days.

(21) Appl. No.: 09/805,529

(22) Filed: Mar. 13, 2001

(65) Prior Publication Data

US 2001/0030632 A1 Oct. 18, 2001

(30) Foreign Application Priority Data

Mar. 13, 2000 (JP) ..... 2000-068707

(51) Int. Cl.
*G09G 3/28* (2006.01)

(52) U.S. Cl. ..... 345/60; 345/63; 345/67

(58) Field of Classification Search ..... 345/60, 345/66–68, 71, 63; 315/169.3, 169.4, 85
See application file for complete search history.

(56) References Cited

U.S. PATENT DOCUMENTS 4,900,987 A * 2/1990 Otsuka et al. ..... 315/169.4
5,909,199 A * 6/1999 Miyazaki et al. ..... 345/60
6,160,349 A * 12/2000 Nagai ..... 315/85
6,219,013 B1 4/2001 Amano ..... 345/60
6,262,699 B1 * 7/2001 Suzuki et al. ..... 345/68
6,333,599 B1 12/2001 Kawanami et al. ..... 313/582
6,369,781 B2 4/2002 Hashimoto et al. ..... 345/60
6,376,995 B1 * 4/2002 Kato et al. ..... 315/169.3
6,426,732 B1 * 7/2002 Makino ..... 345/68
6,456,265 B1 * 9/2002 Mikoshiba et al. ..... 345/66
6,466,186 B1 * 10/2002 Shimizu et al. ..... 345/60

FOREIGN PATENT DOCUMENTS

| | | |
|---|---|---|
| JP | 10-333635 | 12/1998 |
| JP | 11-109914 | 4/1999 |
| JP | 11-212515 | 8/1999 |
| JP | 2001-013919 | 1/2001 |
| JP | 2001-125537 | 5/2001 |
| WO | WO 98/21706 | 5/1998 |
| WO | WO 99/18561 | 4/1999 |

* cited by examiner

*Primary Examiner*—Jimmy H. Nguyen

(57) ABSTRACT

When applying sustain pulses to each discharge cell in a gas discharge panel, a pulse of the opposite polarity is briefly applied immediately before the leading edge of each sustain pulse. Or, the absolute voltage of each sustain pulse is set higher during a certain period from the leading edge of the sustain pulse than during a period from the lapse of the certain period to the trailing edge of the sustain pulse, and a pulse of the opposite polarity is briefly applied immediately after the trailing edge of the sustain pulse. As a result, discharge delays during a discharge sustain period are suppressed to improve image quality, and reactive currents are reduced to improve luminous efficiency.

15 Claims, 23 Drawing Sheets

PRIOR ART

PANEL DISPLAY APPARATUS AND METHOD FOR DRIVING A GAS DISCHARGE PANEL

BACKGROUND OF THE INVENTION

1. Field of the Invention

The present invention relates to a gas discharge panel display apparatus and a method for driving a gas discharge panel used for image display for computers, televisions, and the like. The invention particularly relates to an AC plasma display panel which writes an image by accumulating a charge in a dielectric layer and illuminates discharge cells by performing a sustain discharge.

2. Related Art

In recent years, gas discharge panels including plasma display panels (hereafter referred to as PDPs) have become the focus of attention for their ability to realize a large, slim and lightweight display apparatus for use in computers, televisions, and similar. In these gas discharge panels, a PDP produces an image display by selectively illuminating discharge cells arranged in the form of matrix.

PDPs can be broadly divided into two types: direct current (DC) and alternating current (AC). AC PDPs are suitable for large-screen use and so are at present the dominant type.

Discharge cells in an AC PDP are fundamentally only capable of two display states, ON and OFF. Here, a field timesharing gradation display method in which one frame (one field) is divided into a plurality of sub-frames (sub-fields) and the ON and OFF states in each sub-frame are combined to express a gray scale is used.

For image display in each sub-frame, an ADS (Address Display-period Separation) method is employed. In this method, each sub-frame is composed of the following sequence: a set-up period, a write period, a discharge sustain period, and an erase period, as shown in FIG. 25. In the write period, a wall charge is accumulated in the discharge cells which should be illuminated, to write an image. In the discharge sustain period, AC sustain pulses are applied to all discharge cells. The voltage of the sustain pulses applied here is set within such a range that causes a discharge to occur only in the discharge cells where the wall charge has accumulated (usually in a range of 150V to 200V).

This illumination principle is basically the same as that of a fluorescent lamp. When a sustain pulse is applied to cause a normal glow discharge, ultraviolet light (Xe resonance lines with a wavelength of 147 nm) is generated from Xe and excites a phosphor to emit light. However, since the efficiency of the conversion from discharge energy to ultraviolet light and the efficiency of the conversion from ultraviolet to visible light in a phosphor are not high, a PDP cannot produce as high brightness as a fluorescent lamp.

Also, there is the demand for high-definition PDPs, just as other types of display (high-definition television with high resolutions of up to 1920×1080 pixels at full specification is currently being introduced). However, such a high-definition PDP is likely to suffer further decreases in luminous efficiency. In view of these points, an important issue in the PDP technology is to increase luminous efficiency (i.e. the amount of brightness with respect to the amount of power). To achieve this, techniques of improving structures of PDPs and techniques of recovering currents (reactive currents) which do not contribute to ultraviolet light emission are being developed. Also, techniques for suppressing the occurrence of reactive currents are being sought.

Furthermore, a rectangular wave is generally used for sustain pulses, as shown in FIG. 25. The leading edge of the rectangular wave is sharper than the leading edge of a wave such as a trigonometrical function wave. Accordingly, using a rectangular wave for a sustain pulse enables a discharge to start comparatively soon after the leading edge of the sustain pulse, with it being possible to display an image with relative stability.

However, when applying a sustain pulse, there is a certain probability that so-called "discharge delay" occurs. The discharge delay refers to a substantial time delay from the leading edge of the pulse to the start of the discharge. In particular, the discharge delay tends to occur for a sustain pulse which is first applied in a discharge sustain period.

This discharge delay causes a drop in image quality. Which is to may, if there is a certain probability of occurrence of discharge delay in a PDP in which a large number of discharge cells are aligned, discharge delays may occur in part of the discharge cells which are to be illuminated. When this happens, illumination failures will result, and the quality of the displayed image will decrease. Therefore, techniques for preventing discharge delays are desired, too.

SUMMARY OF THE INVENTION

The first object of the present invention is to improve luminous efficiency by suppressing reactive currents, when driving a gas discharge panel such as a PDP.

The second object of the invention is to improve image quality by suppressing discharge delays in a discharge sustain period.

To achieve the first object, a waveform of a sustain pulse is determined so that a current waveform which completes a fall by the time triple a rise time to a peak elapses from when the peak is reached is formed when the sustain pulse is applied.

This particular current waveform can be formed by providing any of the following first to third features to the sustain pulse.

(1) First Feature: Applying a pulse of the opposite polarity briefly before the leading edge of the sustain pulse.

(2) Second Feature: Set the absolute voltage of the sustain pulse higher during a fixed period after the leading edge of the sustain pulse, than during a period following the fixed period.

(3) Third Feature: Applying a pulse of the opposite polarity immediately after the trailing edge of the sustain pulse.

By forming the above particular current waveform, reactive currents are suppressed when compared with the case where a sustain pulse of a conventional waveform is applied, with it being possible to improve luminous efficiency.

In addition, the provision of each of the first to third features to the sustain pulse produces the following effects.

The effects produced by the provision of the first feature are as follows.

Electrons move from one electrode toward the other in a discharge space when the opposite polarity pulse is applied before the leading edge of the sustain pulse, but are pulled back toward the electrode without reaching the other electrode when the sustain pulse is applied.

As a result of such an initial reciprocating motion of the electrons in the discharge space, a lot of charged particles (electrons and ions) that contribute to light emission are generated, which further improves luminous efficiency.

Also, with the reciprocating motion of the charged particles between the two electrodes, a source of discharge is formed, which enables the discharge to start with reliability.

Hence the suppression of discharge delays which is the second object of the invention is achieved.

To ensure these effects, the absolute voltage of the opposite polarity pulse is preferably no smaller than the absolute voltage of the sustain pulse, and more preferably no smaller than 1.5 times the absolute voltage of the sustain pulse.

Here, the time for applying the opposite polarity pulse is preferably 100 ns or below.

Also, the time during which the absolute voltage of the opposite polarity pulse is no smaller than the absolute voltage of the sustain pulse is preferably 100 ns or below, and more preferably 50 ns or below.

The effects produced by the provision of the second feature are as follows.

When a high voltage is applied for a fixed period from the leading edge of the sustain pulse, the discharge is started with reliability, and the discharge delay is suppressed.

This effect can be enhanced by applying a voltage no smaller than a discharge firing voltage of the discharge cell, in the fixed period.

Here, it is preferable to apply a voltage which is higher in absolute value than a voltage applied thereafter by 50V or more, in the fixed period.

In general, applying a high voltage tends to cause a dielectric breakdown of a dielectric layer or an increase of power consumption. However, by setting the time for applying the high voltage (which is no smaller than the discharge firing voltage) to a short time of no greater than 100 ns or even no greater than 10 ns, the dielectric breakdown and the power consumption increase can be avoided.

The effects produced by the provision of the third feature are as follows.

When the opposite polarity pulse is applied after the trailing edge of the sustain pulse, reactive currents caused by ions remaining in the discharge cell can be suppressed.

Which is to say, the ions remaining in the discharge cell after the trailing edge of the sustain pulse show low activities and do not contribute to light emission. When such ions reach an electrode, reactive currents are generated and cause a decrease in luminous efficiency. With the provision of the third feature, however, such reactive currents are suppressed, thereby significantly improving luminous efficiency.

Here, the highest absolute voltage of the opposite polarity pulse is preferably 50V or more.

Also, the time for applying the opposite polarity pulse is preferably 100 ns or below, and more preferably ions or below.

It should be noted that usually a plurality of sustain pulses of alternating polarity are successively applied to each discharge cell during one discharge sustain period. Although, it is desirable to add the aforementioned waveform features to all sustain pulses which are applied in the discharge sustain period in order to maximize the effects of the invention, the waveform features may instead be added to only part of the sustain pulses. In such a case, the features should be added at least to a sustain pulse which is first applied to each discharge cell in the discharge sustain period.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

DESCRIPTION CF THE PREFERRED EMBODIMENT(S)

Overall Construction of a Display Apparatus

Figure 1:
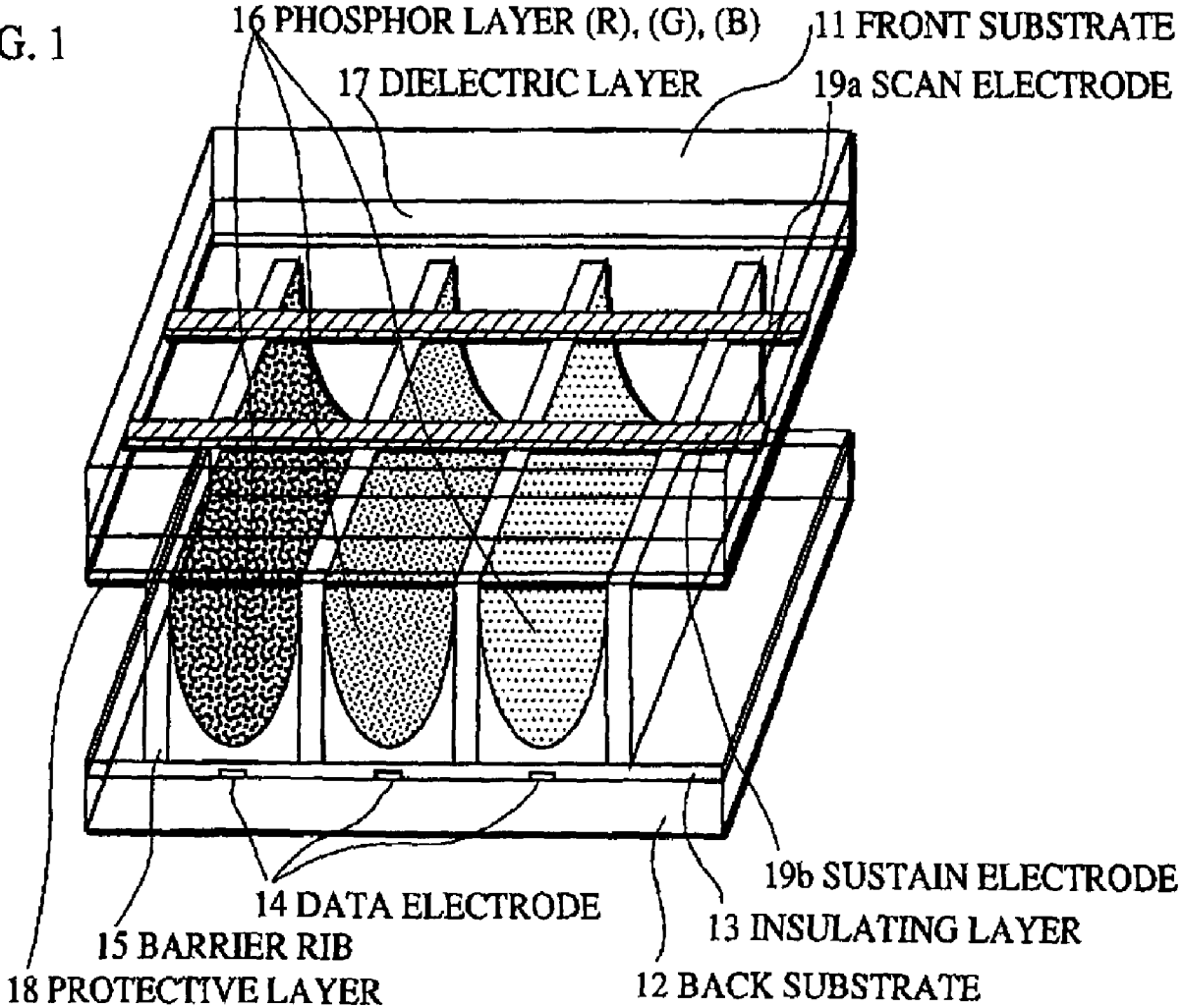
FIG. 1 is a sketch drawing of a surface discharge AC PDP to which the embodiments of the invention relate.

First, an overall construction of a PDP display apparatus to which the embodiments of the invention relate is explained The PDP display apparatus includes a surface discharge AC PDP and a driving apparatus for the PDP. FIG. 1 is a sketch diagram of the PDP.

In this PDP, a front substrate 11 and a back substrate 12 are placed in parallel so as to face each other with a space in between. The edges of the substrates 11 and 12 are then sealed.

A scan electrode group 19*a* and a sustain electrode group 19*b* are formed in parallel strips on the inward-facing surface of the front substrate 11. The electrode groups 19*a* and 19*b* are covered by a dielectric layer 17 composed of lead glass or similar. The surface of the dielectric layer 17 is then covered with a protective layer 18 of magnesium oxide (MgO). A data electrode group 14 is formed in parallel strips on the inward-facing surface of the back substrate 12, and covered by a dielectric layer 13 composed of lead glass or similar. Barrier ribs 15 are placed on top of the dielectric layer 13, in parallel with the data electrode group 14. The space between the front substrate 11 and the back substrate 12 is divided into spaces of about 100 μm to 200 μm by the barrier ribs 15. Discharge gas is sealed in these spaces. The pressure at which the discharge gas is enclosed is usually set below external (atmospheric) pressure, typically in a range of around $1\times10^4$ Pa to $7\times10^4$ Pa. However, setting the pressure at $8\times10^4$ Pa or higher is preferable for higher luminous efficiency.

Figure 2:
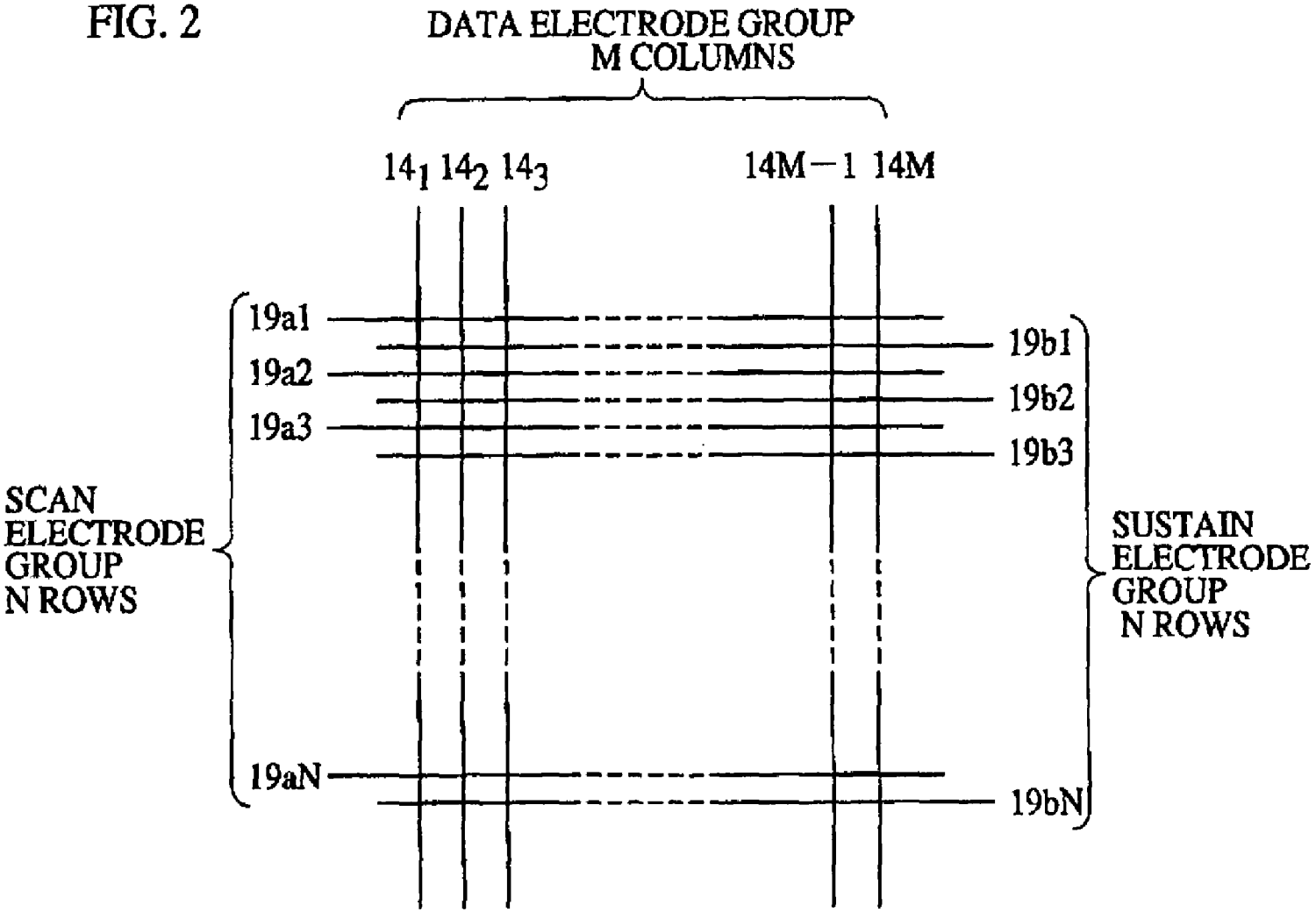
FIG. 2 shows an electrode matrix for the PDP shown in FIG. 1.

FIG. 2 shows an electrode matrix for the POP. The electrode groups 19*a* and 19*b* are arranged at right angles to the data electrode group 14. Discharge cells are formed in the space between the front substrate 11 and the back substrate 12, at the points where the electrodes intersect. The barrier ribs 15 separate adjacent discharge cells, preventing discharge diffusion between adjacent discharge cells. As a result, a high resolution display can be achieved.

In monochrome PDPS, a gas mixture composed mainly of neon is used as the discharge gas, emitting visible light when a discharge is performed. However, in a color PDP like the one in FIG. 1, phosphor layers 16 composed of phosphors for the three primary colors red (R), green (G) and blue (B) are formed on the inner walls of the discharge cells, and a gas mixture composed mainly of xenon (such as neon/xenon or helium/xenon) is used as the discharge gas. Color display takes place by converting ultraviolet light generated by a discharge into visible light of various colors using the phosphor layers 16.

This PDP is driven using the field timesharing gradation display method.

Figure 3:
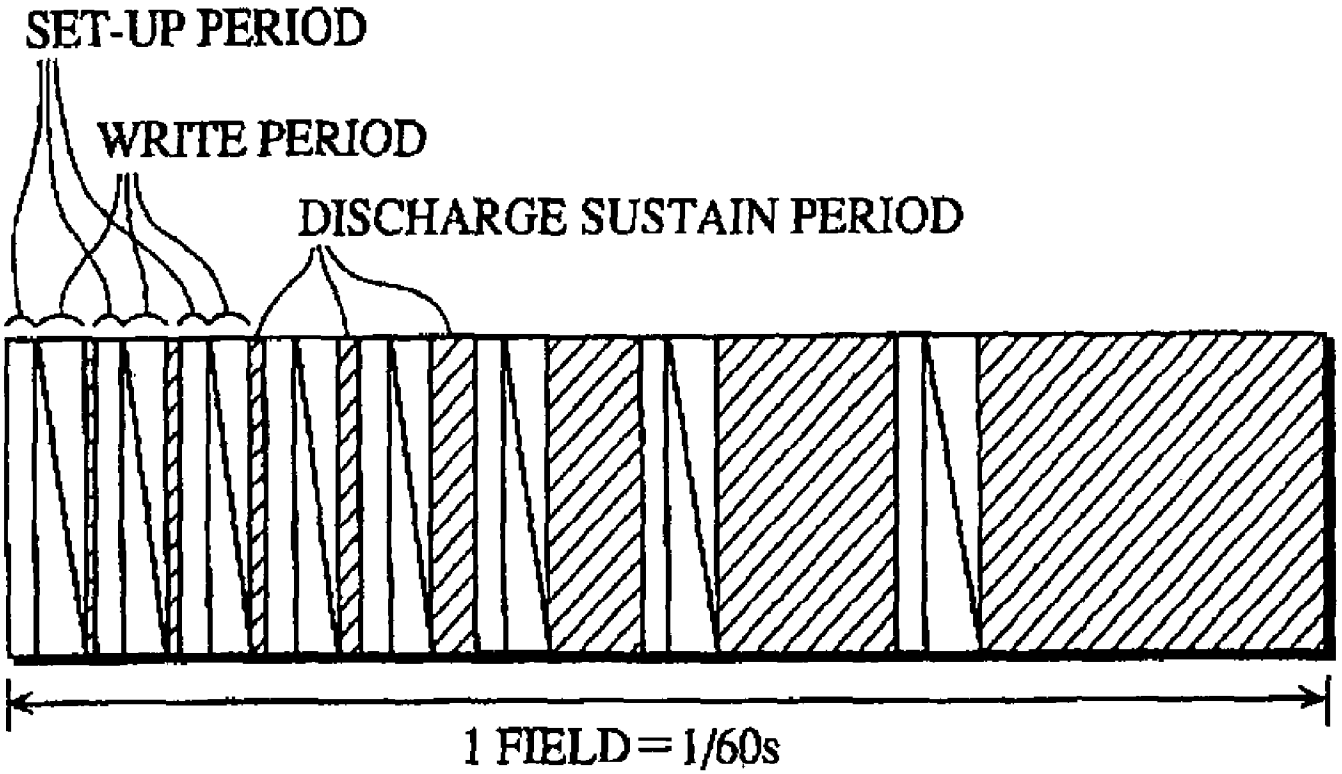
FIG. 3 shows a frame division method when the PDP is driven.

FIG. 3 shows a division method for one frame when a 256-level gray scale is expressed. The horizontal axis shows time, and the shaded parts show discharge sustain periods.

In the example division method shown in FIG. 3, one frame is made up of eight sub-frames. The ratios of the discharge sustain periods for these sub-frames are set respectively at 1, 2, 4, 8, 16, 32, 64, and 128. These eight-bit binary combinations express a 256-level gray scale. The NTSC (National Television System Committee) standard for television images stipulates a frame rate of 60 frames per second, so the time for one frame is set at 16.7 ms.

The ADS method is applied to each sub-frame to display an image on the PDP. Each sub-frame is composed of the following sequence: a set-up period, a write period, a discharge sustain period, and an erase period.

Figure 4:
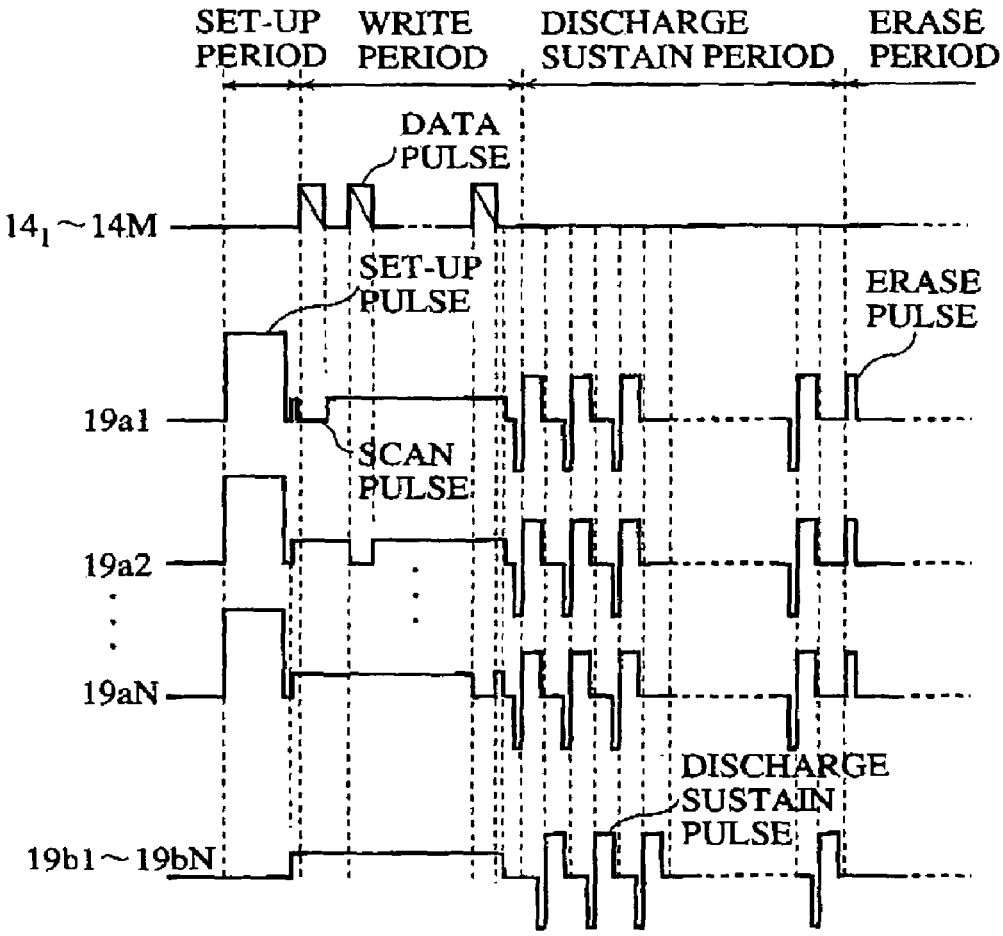
FIG. 4 is a time chart showing when pulses are applied to electrodes, according to the first embodiment of the invention.

FIG. 4 is a time chart showing when pulses are applied to electrodes in one sub-frame.

In the set-up period, all of the discharge cells are set-up by applying set-up pulses to the scan electrodes 19*a*.

In the write period, data pulses are applied to selected data electrodes 14 while scan pulses are applied sequentially to the scan electrodes 19*a*. This causes a wall charge to accumulate in the discharge cells which should be illuminated, writing one screen of pixel information.

In the discharge sustain period, sustain pulses are applied across the scan electrodes 19*a* and the sustain electrodes 19*b*, causing a discharge to occur in the discharge cells where the wall charge has accumulated, and light to be emitted for a predetermined period.

In FIG. 4, each sustain pulse has not a simple rectangular waveform but a particular waveform This will be explained later In the erase period, narrow erase pulses are applied in bulk to the scan electrodes 19*a* or the sustain electrodes 19*b*, causing the wall charge in all of the discharge cells to be erased.

Detailed Explanation of the Driving Apparatus and Driving Method

Figure 5:
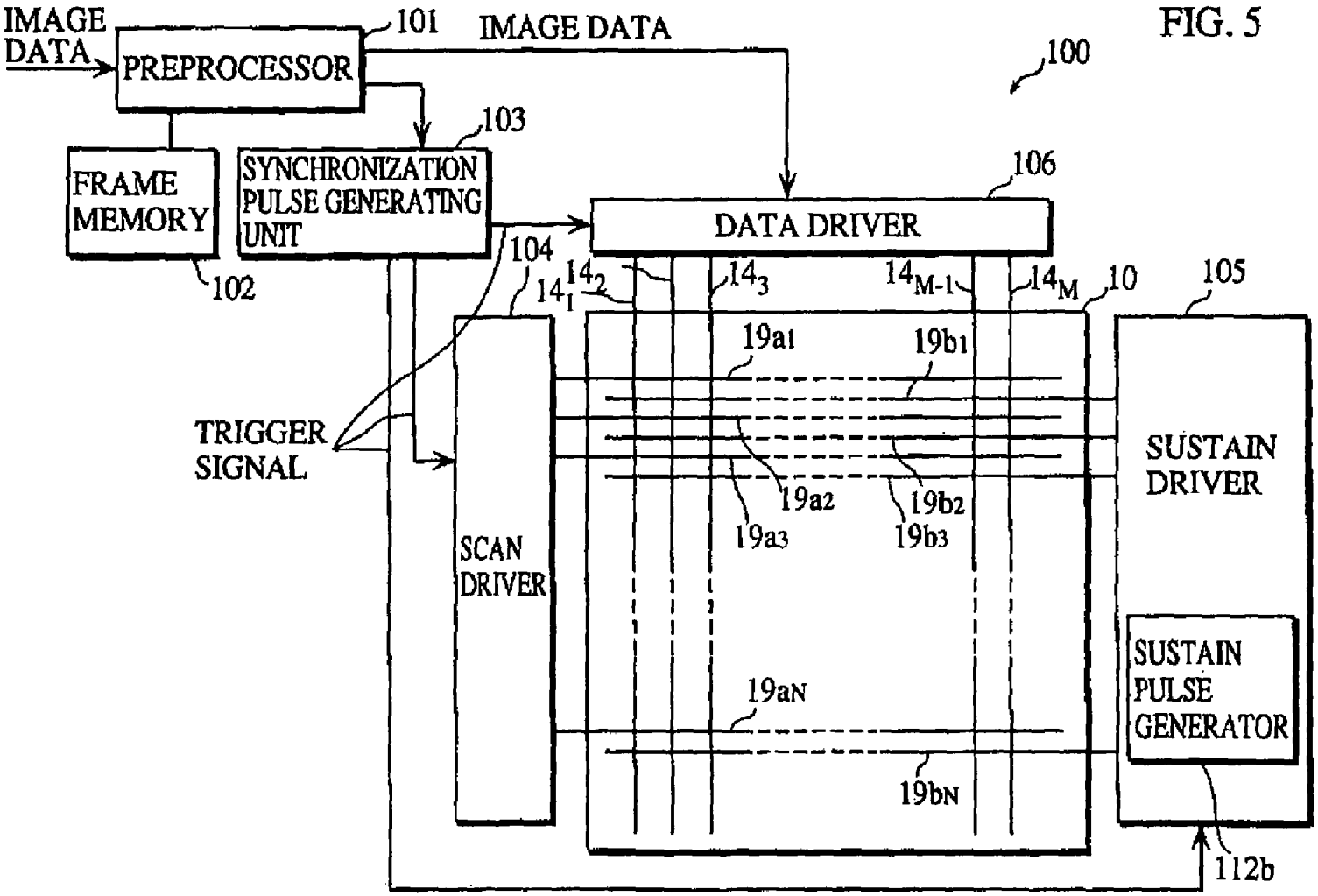
FIG. 5 is a block diagram of a construction of a POP driving apparatus to which the embodiments of the invention relates.

FIG. 5 is a block diagram of a construction of a driving apparatus 100.

The driving apparatus 100 includes a preprocessor 101, a frame memory 102, a synchronization pulse generating unit 103, a scan driver 104, a sustain driver 105, and a data driver 106. The preprocessor 101 processes image data inputted from an external image output device. The frame memory 102 stores the processed image data. The synchronization pulse generating unit 103 generates synchronization pulses for each frame and each sub-frame.

The scan driver 104 applies pulses to the scan electrode group 19*a*, the sustain driver 105 to the sustain electrode group 19*b*, and the data driver 106 to the data electrode group 14.

The preprocessor 101 extracts image data for each frame from the input image data, produces image data for each sub-frame (sub-frame image data) from the extracted image data, and stores it in the frame memory 102. Also, the preprocessor 101 outputs sub-frame image data stored in the frame memory 102 line by line to the data driver 106, detects synchronization signals such as horizontal synchronization signals and vertical synchronization signals from the input image data, and sends synchronization signals for each frame and sub-frame to the synchronization pulse generating unit 103.

The frame memory 102 is capable of storing the data for each frame split into sub-frame image data for each sub-frame.

Specifically, the frame memory 102 is a two-port frame memory provided with two memory areas each capable of storing one frame (eight sub-frame images). An operation in which image data for one frame is written in one memory area while image data for another frame written in the other memory area is read can be performed alternately on the memory areas.

The synchronization pulse generating unit 103 generates trigger signals indicating the timing at which each of the setup, scan, sustain, and erase pulses should rise. These trigger signals are generated with reference to the synchronization signals received from the preprocessor 101 regarding each frame and each sub-frame, and sent to the drivers 104 to 106.

The scan driver 104 generates and applies the set-up, scan, sustain, and erase pulses in response to the trigger signals received from the synchronization pulse generating unit 103.

Figure 6:
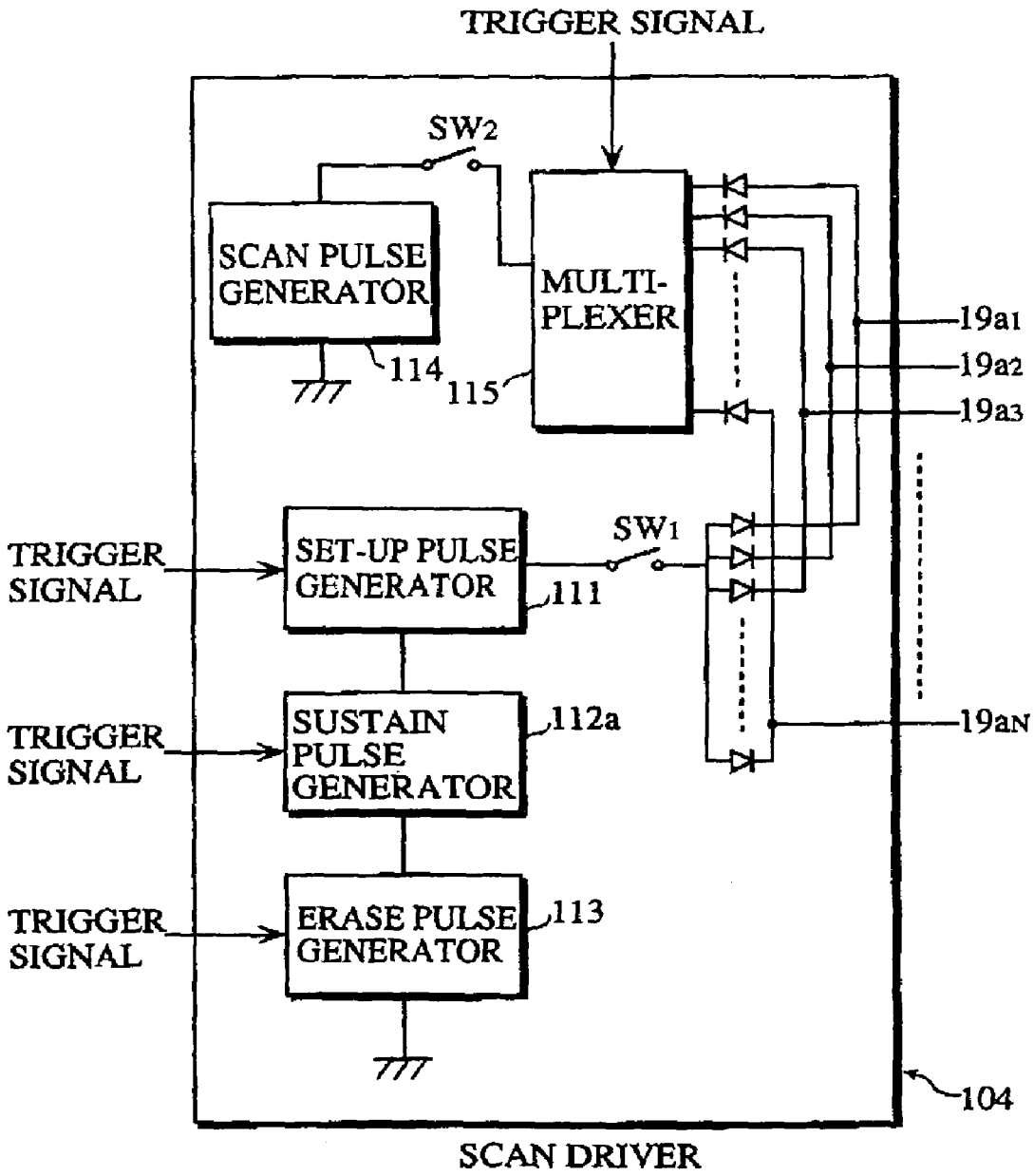
FIG. 6 is a block diagram of a construction of a scan driver shown in FIG. 5.

FIG. 6 is a block diagram showing a construction of the scan driver 104.

The set-up, sustain, and erase pulses are applied to all of the scan electrodes 19*a*.

As a result, the scan driver 104 has three pulse generators, one for generating each kind of pulse, as shown in FIG. 6. These are a set-up pulse generator 111, a sustain pulse generator 112*a*, and an erase pulse generator 113. The three pulse generators are connected in series using a floating ground method, and apply the set-up, sustain, and erase pulses in turn to the scan electrode group 19*a*, in response to trigger signals from the synchronization pulse generating unit 103.

In FIG. 6, the scan driver 104 also includes a scan pulse generator 114 and a multiplexer 115 connected to the scan pulse generator 114, which enable scan pulses to be applied in sequence to the scan electrodes $\mathbf{19}a_1$, $\mathbf{19}a_2$ and so on, as far as 19*a*. A method in which pulses are generated in the scan pulse generator 114 and output switched by the multiplexer 115 is used here, but a structure in which a separate scan pulse generating circuit is provided for each scan electrode 19*a* may also be used.

Switches $SW_1$ and SW are arranged in the scan driver 104 to selectively apply the output from the above pulse generators 111, 112*a*, and 113 and the output from the scan pulse generator 114, to the scan electrode group 19*a*.

The sustain driver 105 includes a sustain pulse generator 112*b*. The sustain driver 105 generates sustain pulses in response to trigger signals from the synchronization pulse generating unit 103, and applies the sustain pulses to the sustain electrodes 19*b*.

The data driver 106 outputs data pulses to the data electrodes $\mathbf{14}_1$ to $\mathbf{14}_M$ in parallel. The output takes place based on sub-field information which is inputted serially into the data driver 106 one line at a time.

Figure 7:
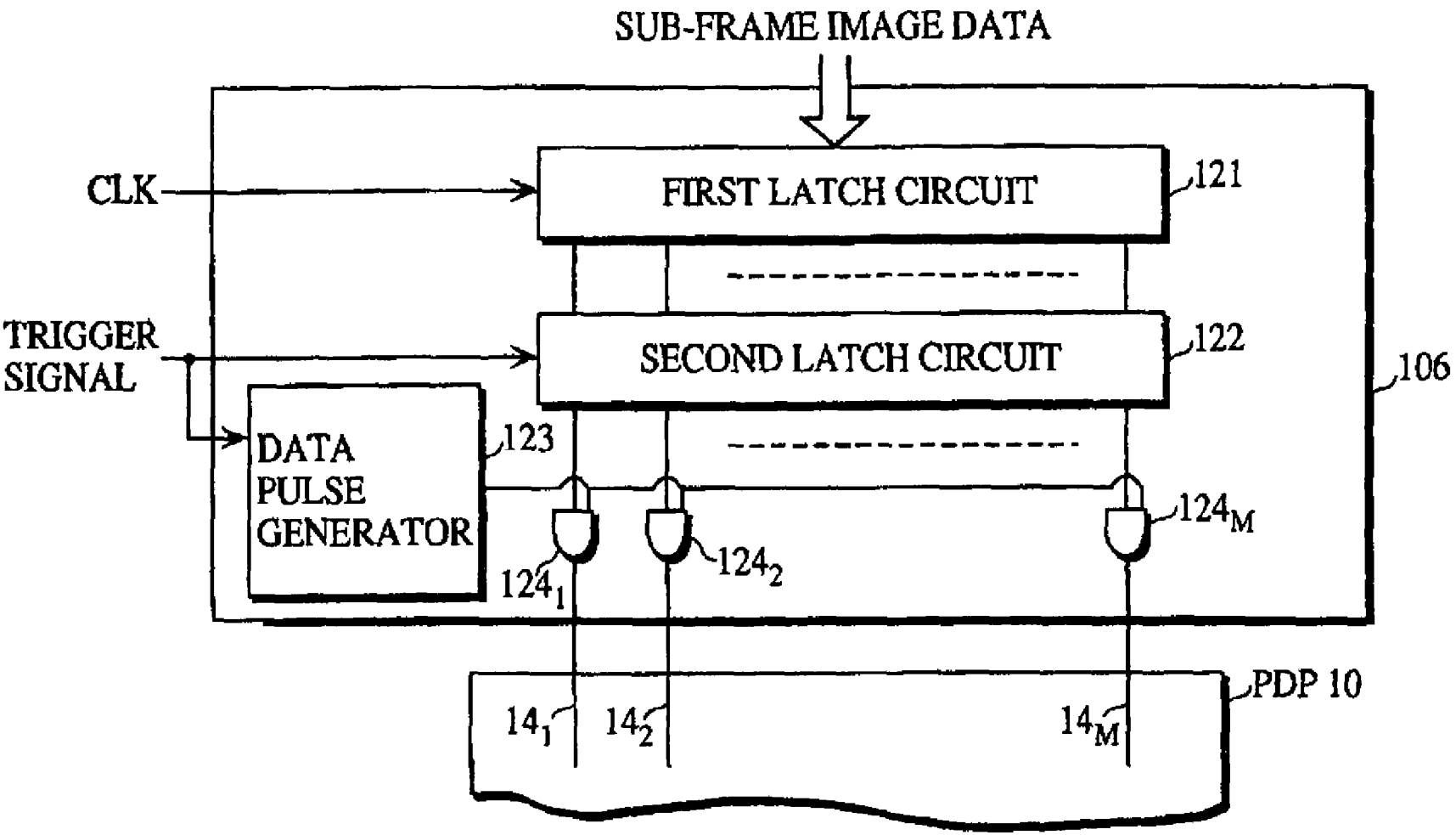
FIG. 7 is a block diagram of a construction of a data driver shown in FIG. 5.

FIG. 7 is a block diagram of a construction of the data driver 106.

The data driver 106 includes a first latch circuit 121 which fetches one scan line of sub-frame image data at a time, a second latch circuit 122 which stores the fetched data, a data pulse generator 123 which generates data pulses, and gates 124, to $\mathbf{124}_M$ located at the entrance to each data electrode $\mathbf{14}_1$ to $\mathbf{14}_M$.

In the first latch circuit 121, sub-frame image data sent in order from the preprocessor 101 is synchronized with a CLK (clock) signal and fetched sequentially so many bits at a time. Once one scan line of sub-frame image data (information showing whether each of the data electrodes $\mathbf{14}_1$ to $\mathbf{14}_M$, is to have a data pulse applied) has been latched, it is transferred to the second latch circuit 122. The second latch circuit 122 opens AND gates, among the AND gates $\mathbf{124}_1$ to $^{124}{}_M$, which correspond to the data electrodes that are to have the pulses applied, in response to trigger signals from the synchronization pulse generating unit 103. The data pulse generator 123 generates the data pulses simultaneously with this, as a result of which the data pulses are applied to the data electrodes with their AND gates opened.

In such a driving apparatus 100, the operations for one sub-frame composed of a sequence of the set-up, write, discharge sustain, and erase periods are repeated eight times to display a one-frame image, as explained below it should be noted here that the number of sub-frames may be set at more than eight to suppress false contours.

In the set-up period, switches $SW_1$ and $SW_2$ in the scan driver 104 are ON and OFF respectively. The set-up pulse generator 111 applies a set-up pulse to all of the scan electrodes 19*a*, causing a set-up discharge to occur in all of the discharge cells, and a wall charge to accumulate in each discharge cell. Here, applying a certain amount of wall voltage to each discharge cell enables a write discharge occurring in the following write period to commence sooner.

In the write period, switches $SW_1$ and $SW_2$ in the scan driver 104 are OFF and ON respectively. Negative voltage scan pulses generated by the scan pulse generator 114 are applied sequentially from the scan electrode $\mathbf{19}a_1$ in the first row to the scan electrode $\mathbf{19}a_N$ in the last row. Simultaneously, the data driver 106 performs a write discharge by applying positive voltage data pulses to data electrodes, among the data electrodes $\mathbf{14}_1$ to $\mathbf{14}_M$, which correspond to the discharge cells to be illuminated, thereby accumulating a wall charge in these discharge cells. Thus, a one-screen latent image is written by accumulating the wall charge on the surface of the dielectric layer in the discharge cells which are to be illuminated.

Here, the scan pulses and the data pulses (the write pulses in other words) should be set as narrow as possible, to enable driving to be performed at high speed. However, if the write pulses are too narrow, write defects are likely. Besides, limitations in the type of circuitry that may be used mean that the pulse width usually needs to be set at about 1.0 μs or more.

In the discharge sustain period, switches $SW_1$ and $SW_2$ in the scan driver 104 are ON and OFF respectively. The operation in which the sustain pulse generator 112*a* applies a sustain pulse of a fixed duration (for example 1 μs to 5 μs) to the entire scan electrode group 19*a* and the sustain pulse generator 112*b* in the sustain driver 105 applies a discharge pulse of a fixed duration to the entire sustain electrode group 19*b* are alternated repeatedly.

This operation raises the electric potential of the surface of the dielectric layer above a discharge firing voltage in the discharge cells in which the wall charge had accumulated during the write period, so that a discharge occurs in such discharge cells. This sustain discharge causes ultraviolet light to be emitted within the discharge cells. The ultraviolet light excites the phosphors in the phosphor layers 16 to emit visible light corresponding to the color of the phosphor layer 16 in each of the discharge cells.

In the erase period, switches $SW_1$ and $SW_2$ in the scan driver 104 are ON and OFF respectively. A narrow erase pulse is applied to the entire scan electrode group 19*a* by the erase pulse generator 113, erasing the wall charge in each discharge cell by generating a partial discharge.

Pulse Waveform in the Discharge Sustain Period

The following is an explanation on the particular waveform of the sustain pulses applied across the scan electrode group 19*a* and the sustain electrode group 19*b* in the discharge sustain period, and its effect.

In this invention, a waveform of a sustain pulse is adjusted so that a current waveform which completes the fall by the time triple the rise time to the peak elapses since the peak is reached is formed when the sustain pulse is applied.

In other words, when applying a sustain pulse, its waveform is adjusted so that the current becomes extremely small by the time triple the rise time taken to reach the peak elapses since the peak is reached, in order to suppress reactive currents and improve luminous efficiency.

The current waveform having such a property is found to be obtained by providing one of the following three features to the sustain pulse which is to be applied.

(1) First Feature: Apply a pulse of the opposite polarity briefly before the leading edge of the sustain pulse.

(2) Second Feature: Set the absolute value of the voltage of the sustain pulse higher in a fixed period after the leading edge of the sustain pulse, than in a period following the fixed period.

(3) Third Feature; Apply a pulse of the opposite polarity immediately after the trailing edge of the sustain pulse.

It has been shown by experiment that providing one of the first to third features when applying a sustain pulse generates the current waveform with the above property (the current waveform which completes the fall by the time triple the rise time to the peak elapses since the peak is reached).

The reason why the generation of this particular current waveform has the effect of suppressing reactive currents is given below.

Regarding the mechanism of light emission in the discharge space, consider an example when a positive sustain pulse is applied to a scan electrode 19*a*.

Figure 8A:
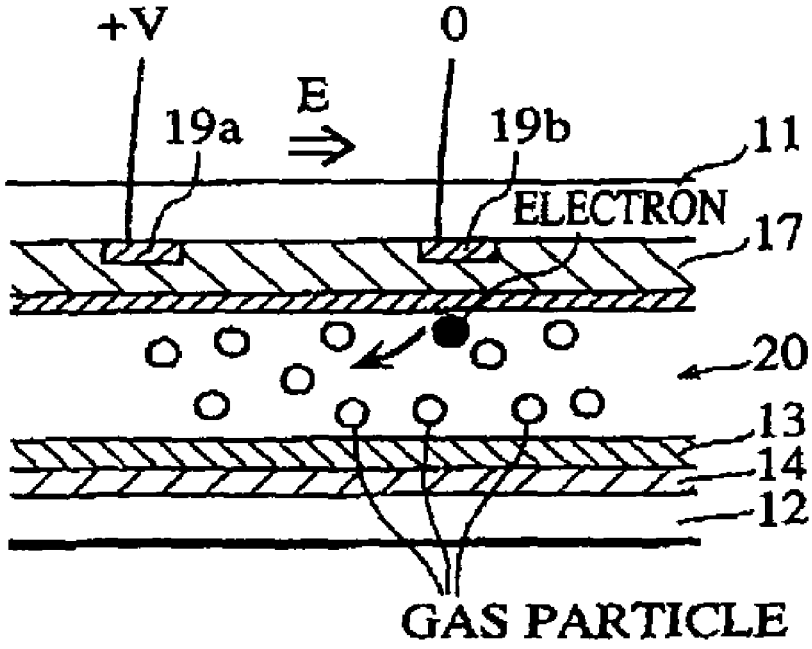
FIGS. 8A and 8B show the movement of current carriers when the sustain pulse is applied.
Figure 8B:
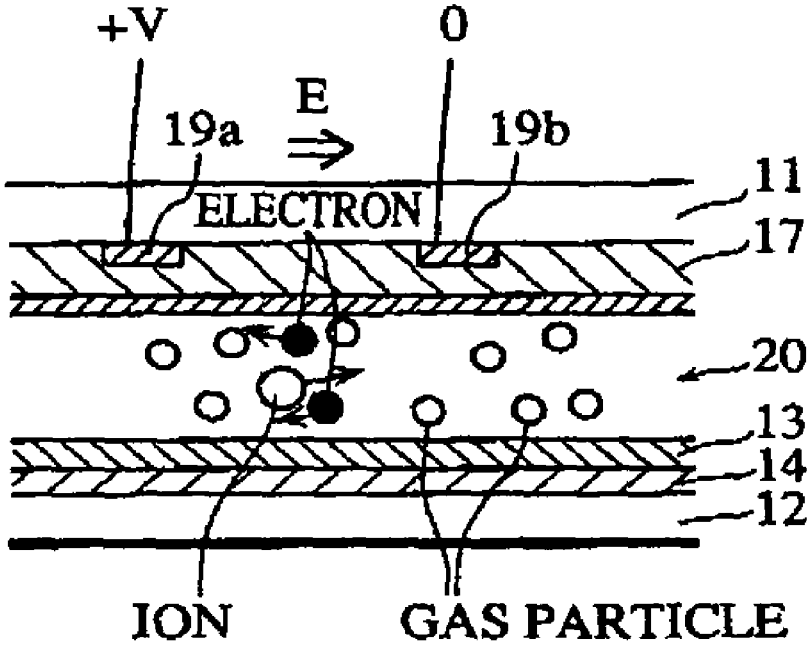

When the positive sustain pulse (+V) is applied to the scan electrode 19*a*, an electric field E emerges in a discharge space 20 in the direction from the electrode 19*a* to an electrode 19*b*, as shown in FIG. 8A. Soon after the application of the sustain pulse starts (initial period), electrons which move from the electrode 19*b* to the electrode 19*a* at an extremely high speed appear in the discharge space 20. These electrons collide with neutral gas particles (Xe), and as a result electrons (e) and ions (Xe+) are generated with excited gas particles, as shown in FIG. 8B. The generated electrons move toward the electrode l9*a* while colliding with other gas particles. This causes a discharge to take place and expand. Meanwhile, the positive ions move toward the electrode 19*b*.

The electrons (e) and the ions (Xe+) in the discharge space 20 are regarded as current carriers. Accordingly, when the electrons (e) or the ions (Xe+) generated in the discharge space 20 reach the electrode 19*a* or 19*b*, currents are generated between the electrodes 19*a* and 19*b*.

When comparing the moving speeds of an electron and an ion in an electric field, the electron moves much faster than the ion due to their difference in mass (their moving speeds differ by several orders of magnitude).

Figure 9A:
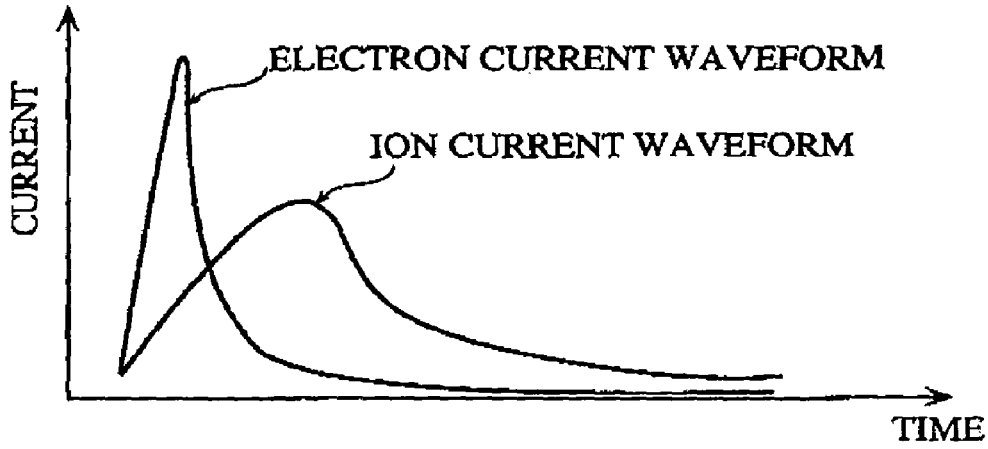
FIGS. 9A to 9C show current waveforms which are formed when the sustain pulse is applied.

Therefore, currents carried by the electrons (electron currents) reach their peak soon after the leading edge of the sustain pulse when the electrons reach the electrode 19*a*, and currents carried by the ions (ion currents) reach their peak relatively later when the ions reach the electrode 19*b*, as shown in FIG. 9A.

Here, the earlier currents which are believed to be caused by the electrons that move fast in the discharge space 20 greatly contribute to light emission, but the later currents which are believed to be caused by the ions that move slowly do not much contribute to light emission. Hence luminous efficiency can be improved by suppressing such later currents.

Also, as noted earlier, if the above first to third features are added to a sustain pulse, such a current waveform that completes the fall by the time triple the rise time to the peak elapses since the peak is reached can be obtained when the sustain pulse is applied. Hence it can be said that the electron currents have this type of waveform.

Accordingly, by forming this particular current waveform, the ion currents which do not much contribute to light emission are suppressed, and the luminous efficiency is increased.

This can be confirmed by the experimental results given below.

Figure 9B:
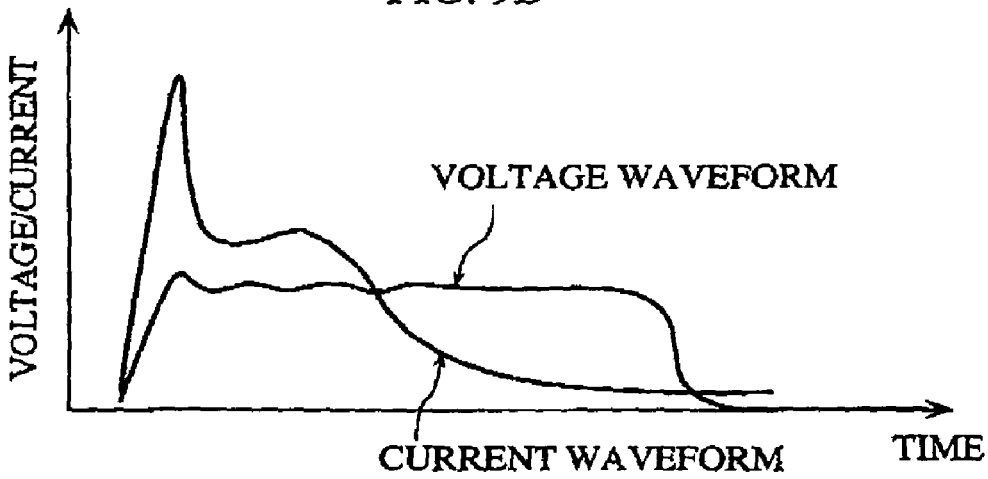
Figure 9C:
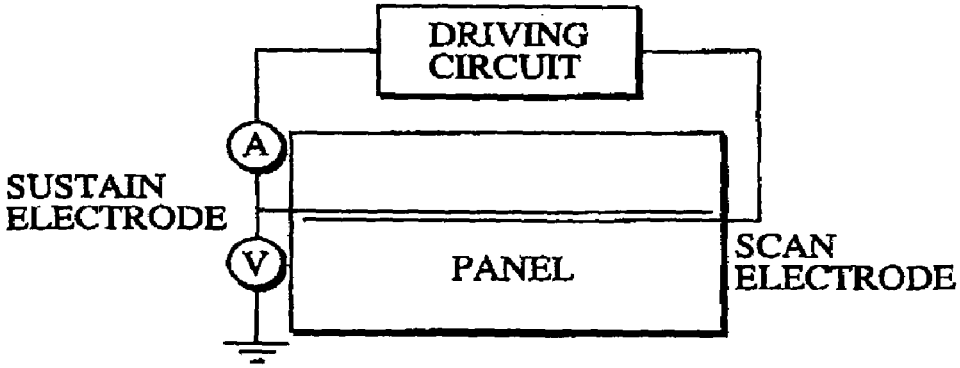

FIG. 9B shows a voltage waveform and current waveform which were observed when a rectangular pulse was applied between a pair of display electrodes in an AC gas discharge panel by a driving circuit. The observations were done using a voltmeter and an ammeter (current probe) inserted in the wiring that connects the driving circuit and the pair of display electrodes, as shown in FIG. 9C.

The current waveform shown in FIG. 9B is similar to the combination of the two current waveforms shown in FIG. 9A. This supports the above explanation.

Figure 10A:
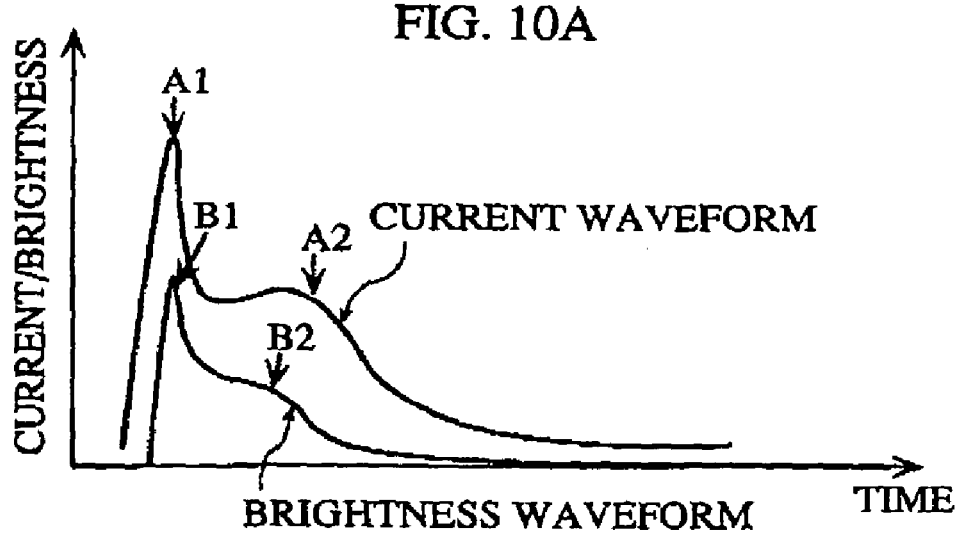
FIGS. 10A to 10C show the relation between current waveforms formed when a sustain pulse is applied, and luminous efficiency.

FIG. 10A shows a current waveform and brightness waveform which were observed when the pulse was applied between the pair of display electrodes in the AC gas discharge panel by the driving circuit. In this current waveform, sharp peak A1 and gentle peak A2 appear earlier and later, respectively. In the luminous waveform, on the other hand, sharp peak B1 appears earlier but gentle peak B2 later is not so apparent. This brightness waveform resembles the electron current waveform shown in FIG. 9A.

Figure 10B:
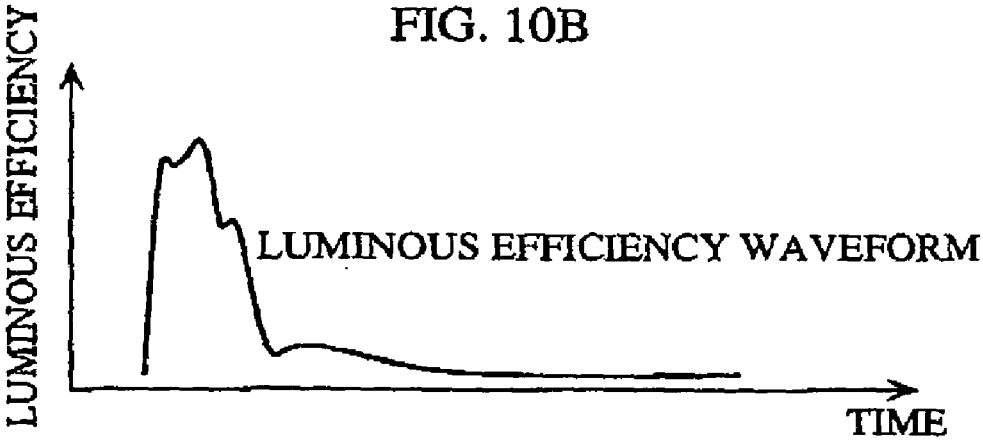

FIG. 10B shows a luminous efficiency waveform which is derived from the voltage waveform and current waveform of FIG. 9B and the brightness waveform of FIG. 10A. The luminous efficiency waveform indicates how the luminous efficiency changes when the sustain pulse is applied (i.e. how the ratio of the brightness to the power inputted for each very short time changes).

Figure 10C:
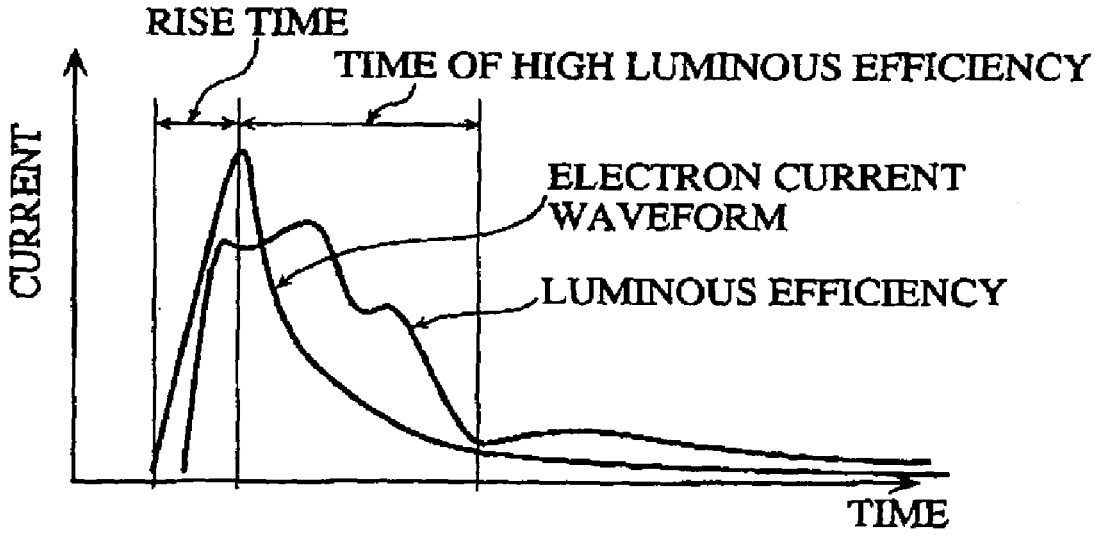

FIG. 10C shows the result of superimposing the luminous efficiency waveform of FIG. 10B and the electron current waveform of FIG. 9A. As illustrated, the peak of the electron current waveform and the peak of the luminous efficiency waveform overlap one another, indicating that high luminous efficiency is obtained when the electron currents flow.

Which is to say, if a current waveform which agrees well with the peak of the above electron current waveform is formed when a sustain pulse is applied, power is concentrated on the time when the luminous efficiency is high, with it being possible to improve luminous efficiency.

The following first to fourth embodiments explain the first to third features and their effects, in greater detail.

First Embodiment

In the first embodiment, a pulse of the opposite polarity is briefly applied prior to the leading edge of each of the positive sustain pulses which are alternately applied to the scan electrode group 19*a* and the sustain electrode group 19*b* in the discharge sustain period, as shown in FIG. 4.

The following explanation focuses on the case where sustain pulses are applied to the scan electrode group 19*a*. Since the same applies to the case where sustain pulses are applied to the sustain electrode group 19*b*, the explanation for the latter has been omitted here.

When applying a positive sustain pulse to each scan electrode. 19*a*, first a pulse of the negative polarity is applied briefly before the rise of the positive sustain pulse, and then the positive sustain pulse (the sustain voltage Vs) is applied.

Here, the value of the sustain voltage Vs is set in such a range that causes a discharge to occur in the discharge cells where the wall charge has accumulated during the write period but does not cause a discharge to occur in the discharge cells where the wall charge has not accumulated. The value of the sustain voltage Vs depends on the design of the PDP (such as the size of the discharge cells, the width of the electrodes, and the thickness of the dielectric layer).

In general, the sustain voltage Vs is set below a discharge firing voltage (Vf) of the discharge cells (in a range of Vf-50V to Vf). In this embodiment, however, the sustain voltage Vs can be set lower than that.

A discharge firing voltage in a PDP can be measured in the following way.

With one's eyes kept on a PDP, a voltage applied from a panel driving apparatus to the PDP is increased little by little. When one discharge cell or a specified number (e.g. three) of discharge cells in the PDP starts emitting light, the applied voltage is read and recorded as the discharge firing voltage.

(Effect of the First Embodiment)

Figure 11A:
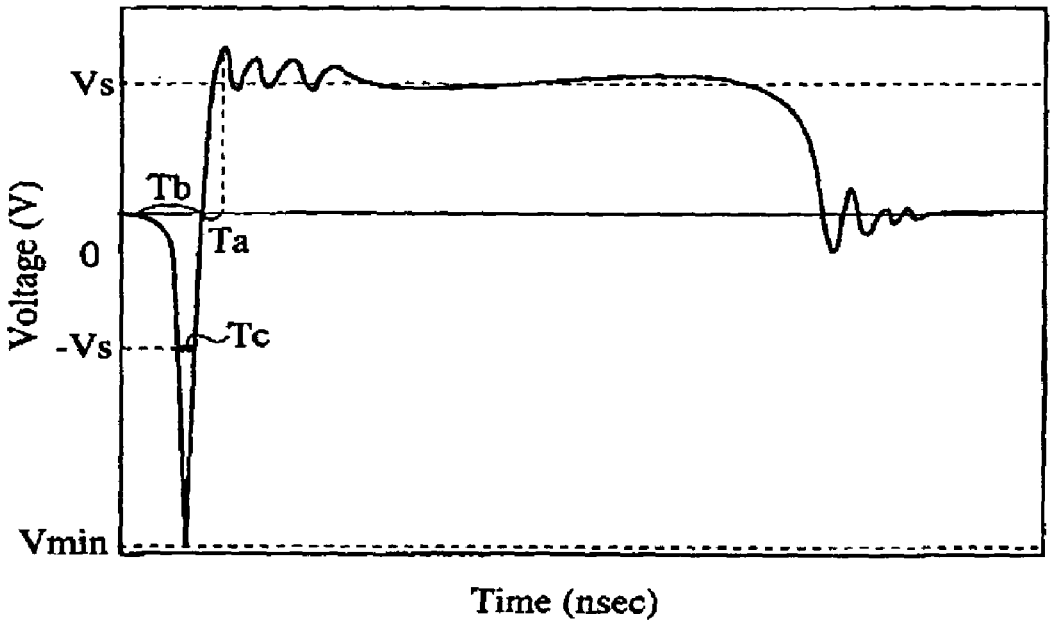
FIG. 11A shows an example of sustain pulse waveform according to the first embodiment of the invention.
Figure 11B:
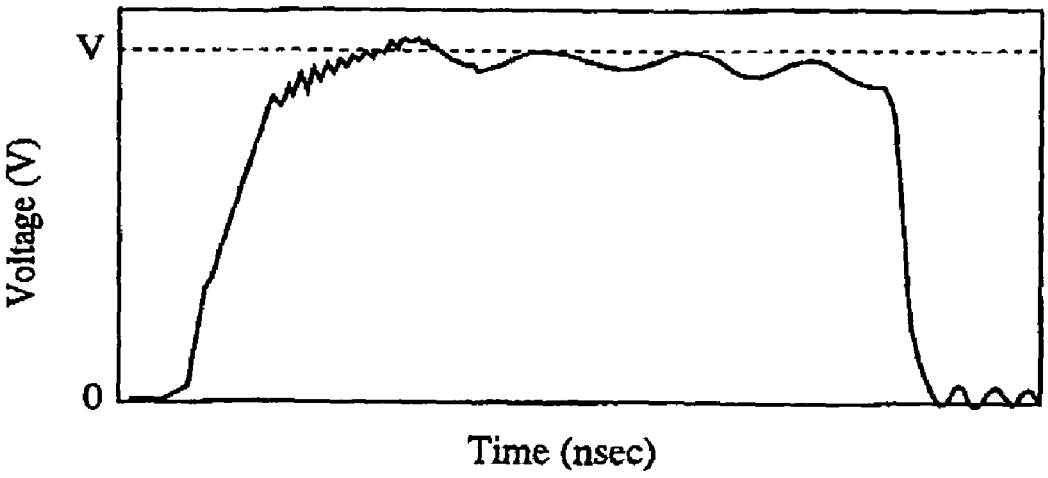
FIG. 11B shows an example of rectangular sustain pulse waveform which is conventionally used.

FIG. 11A shows an example of sustain pulse waveform in the first embodiment. In this example, though the basic part of the sustain pulse is a rectangular wave, a pulse of the opposite polarity is applied briefly before the leading edge of the sustain pulse. FIG. 11B shows an example of sustain pulse waveform which is a conventional rectangular wave.

When the simple rectangular wave shown in FIG. 11B is used, there is a high probability that fast electrons which are generated in the discharge space at an early stage when a sustain pulse is applied will reach from one electrode to the other without contributing to light emission.

Figure 12A:
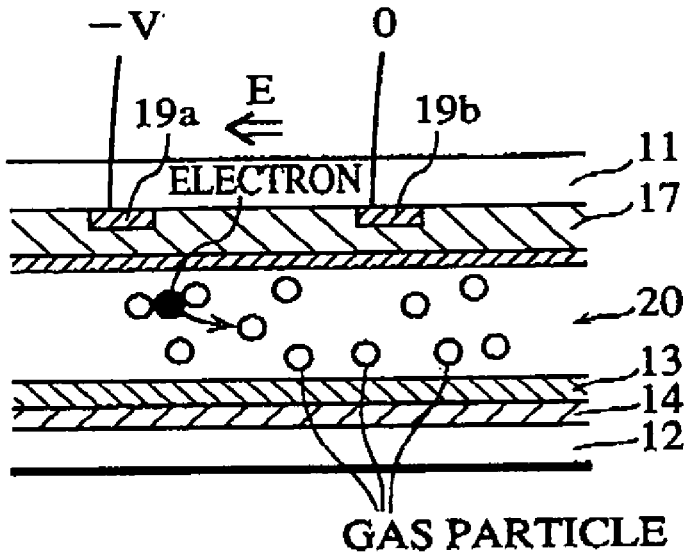
FIGS. 12A and 12B show the movement of current carriers when a sustain pulse is applied.
Figure 12B:
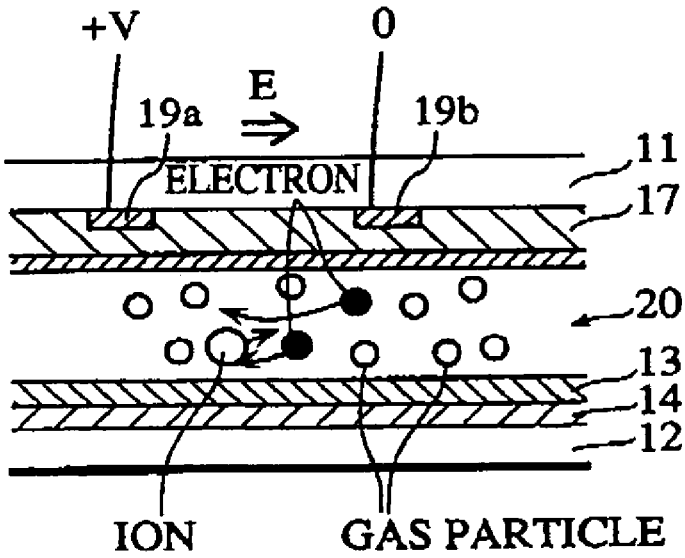

On the other hand, if a negative pulse (−V) is applied briefly before the leading edge of the positive sustain pulse when applying the sustain pulse to the electrode 19*a* as shown in FIG. 11A, this negative pulse causes an electric field E in the discharge space 20 in the direction from the electrode 19*b* to the electrode 19*a*, as shown in FIG. 12A. As a result, electrons which move fast from the electrode l9*a* to the electrode 19*b* emerge in the discharge space 20. After this, when the positive voltage is applied to the electrode 19*a* as shown in FIG. 12B, the electrons are pulled back toward the electrode 19*a* and absorbed by the dielectric layer on the electrode 19*a*.

Thus, when the electrons are moving back and forth in the discharge space 20, the frequency with which the electrons collide with gas particles is high, so that many excited atoms that contribute to light emission are generated. Hence the luminous efficiency is improved when compared with the case where a simple rectangular wave such as the one shown in FIG. 11B is applied.

Also, when a positive sustain pulse of the conventional rectangular wave is applied, a discharge delay may occur due to a voltage drop at the rise of the sustain pulse. The probable cause of the discharge delay is the following. When the sustain pulse rises, currents flow out abruptly, causing a voltage drop. When this happens, it takes time for the voltage to increase again.

However, if the opposite polarity pulse is applied immediately before applying the sustain pulse, the electrons move back and forth and frequently collide with gas particles, which ensures the formation of a source of discharge. Accordingly, a discharge can be started with a high probability while suppressing a discharge delay.

As a result, the discharge can be performed without fail even when the sustain voltage Vs is set comparatively low. In other words, in spite of the fact that the sustain voltage Vs in FIG. 11A is set lower than the sustain voltage V in FIG. 11B, such setting will not cause an increase in discharge delay, so that a satisfactory image display can be produced.

Also, setting the sustain voltage Vs low enables ion currents to be reduced, with it being possible to further improve luminous efficiency.

To achieve the above effects, it is preferable to set the absolute value of the voltage (Vmin in FIG. 11A) of the negative pulse which is applied prior to the rise time (Ta) of the sustain pulse Vs, to be approximately equal to or higher than that of the sustain voltage Vs or discharge firing voltage. It is more preferable to set the absolute value of the voltage Vmin equal to or higher than 1.5 times that of the sustain voltage Vs or discharge firing voltage.

Also, if the time (Tb) during which the negative pulse is applied prior to the rise of the sustain pulse is too long, a problem in which the power consumption increases due to currents flowing during this time period may arise. Especially in the time Tb, if the time Tc during which the absolute value of the voltage Vmin exceeds that of the sustain, voltage Vs (or the discharge firing voltage) is too long, the power consumption increases due to the amount of currents flowing during this time period. Such an increase in power consumption can, however, be significantly suppressed by setting the time Tc short.

In view of these points, the larger the absolute value of the voltage Vmin of the opposite polarity pulse, the shorter the time Tc need be. In general, it is desirable to set the time Tc at 100 ns or below.

Suppose the gap between the scan electrode 19*a* and the sustain electrode 19*b* is 60 μm, and the negative pulse with the voltage Vmin of −400V is applied to the scan electrode 19*a* prior to the leading edge of the positive sustain pulse. Then, if the voltage is changed to positive within 100 ns after the negative voltage no smaller than the discharge firing voltage in absolute value is applied to the scan electrode 19*a*, the polarity changes before the charged particles generated in the discharge space by the application of the negative pulse reach the scan electrode 19*a* (or the sustain electrode 19*b*), so that the charged particles are pulled back toward the sustain electrode 19*b*. (or the scan electrode 19*a*). Accordingly, the amount of currents generated during this period is little. Also, since the charged particles move back and forth between the electrodes 19*a* and 19*b*, a source of discharge is generated. Therefore, if the sustain voltage Vs of the positive polarity pulse is set at about 200V, a discharge is performed reliably without an increase in discharge delay.

Furthermore, it is more preferable to set the time Tc during which the absolute value of the voltage Vmin is no smaller than the discharge firing voltage at 50 ns or below, as the amount of currents flowing during such a time is almost zero.

(Circuit for Adding the Opposite Polarity Pulse to the Sustain Pulse)

Figure 13:
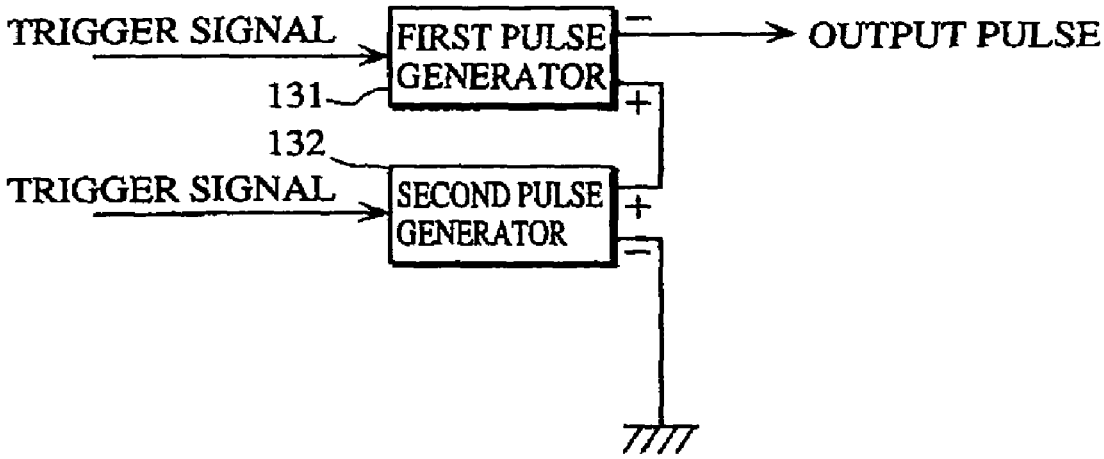
FIG. 13 is a block diagram of a construction of a pulse combining circuit which forms the features of the sustain pulses in the first embodiment.

The opposite polarity pulse can be added to the sustain pulse by providing a pulse combining circuit shown in FIG. 13 in each of the sustain pulse generators 112*a* and 112*b* in FIG. 5 and 6.

FIG. 13 is a block diagram of a construction of the pulse combining circuit for forming the aforementioned particular pulse waveforms.

This pulse combining circuit is roughly made up of a first pulse generator 131 and a second pulse generator 132.

The first pulse generator 131 generates a pulse of negative voltage, and the second pulse generator 132 generates a pulse of positive voltage. A first pulse generated by the first pulse generator 131 is a relatively narrow wave, whereas a second pulse generated by the second pulse generator 132 is a relatively wide rectangular wave.

Also, the timing at which the second pulse rises is set to roughly coincide with the fall of the first pulse.

The first pulse generator 131 and the second pulse generator 132 are connected in series using a floating ground method, so that the output voltages of the first and second pulses are added together.

In this pulse combining circuit, the pulse generators 131 and 132 generate the first and second pulses and combine the generated pulses to an output pulse, in response to trigger signals sent from the synchronization pulse generating unit 103, in the following manner.

Figure 14:
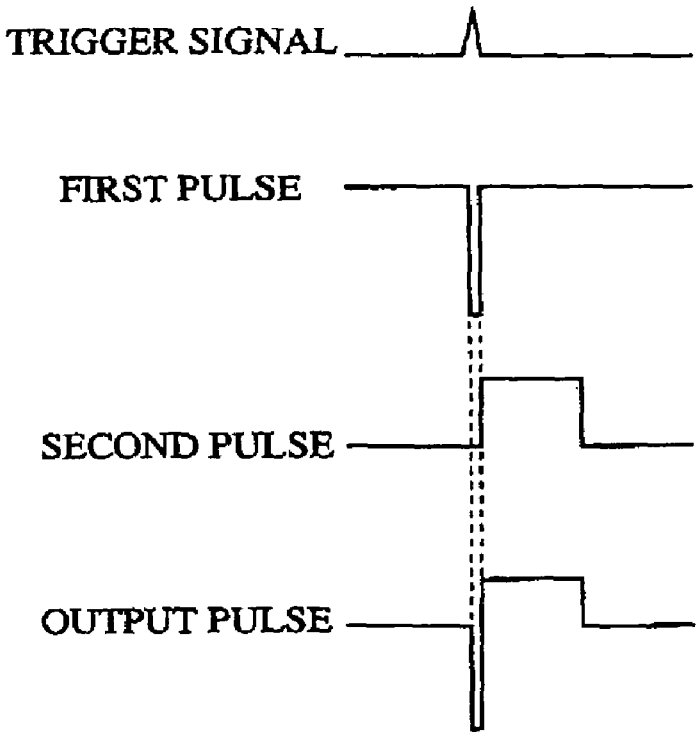
FIG. 14 shows how pulses are combined in the pulse combining circuit shown in FIG. 13.

FIG. 14 shows how the first and second pulses are combined in the pulse combining circuit.

First, the first pulse generator 131 receives a trigger signal from the synchronization pulse generating unit 103, and has the first pulse rise. This first pulse falls after a short time. Almost simultaneously with this, the second pulse generator 132 receives a trigger signal from the synchronization pulse generating unit 103, and has the second pulse rise. After the voltage of the second pulse has been outputted for some time, the second pulse falls.

The pulse combining circuit shown in FIG. 13 may be modified so that the first pulse generator 131 and the second pulse generator 132 are connected in parallel and the larger voltage of the first and second pulses is outputted. In so doing, a similar waveform can be obtained.

(Slope of the Rising Portion of the Opposite Polarity Pulse)

When applying the opposite polarity pulse prior to the sustain pulse, it the slope at which the opposite polarity pulse rises is too sharp, in other words if the applied voltage changes widely in a very short time, a large amount of currents tends to flow and cause a decrease in luminous efficiency.

To ensure high luminous efficiency, the slope of the rising portion of the opposite polarity pulse may be made relatively gentle. However, if the slope of part of the rising portion where the absolute value of the voltage Vmin exceeds the sustain voltage Vs is made gentle, the effect of suppressing discharge delays will be lost.

In consideration of these points, it is preferable that the first half of the rising portion of the opposite polarity pulse is sloped gently to restrict currents, while the latter half of the rising portion is sloped sharply.

The slope at which the opposite polarity pulse rises can be adjusted by adjusting the slope of the rising portion of the first pulse. This can be done by adjusting a time constant of an RLC circuit in the first pulse generator 131.

Second Embodiment

In the second embodiment, the features of the pulses which are formed between the scan electrode group 19*a* and the sustain electrode group 19*b* are the same as the first embodiment.

However, the second embodiment differs with the first embodiment in the following point. The first embodiment describes the case where a voltage is applied to only one of the electrode groups 19*a* and 19*b* at a time, in other words a voltage is not applied to the sustain electrode group 19*b* while a sustain pulse is being applied to the sustain electrode group 19*a*, and a voltage is not applied to the scan electrode group 19*a* while a sustain pulse is being applied to electrode group 19*b*. In the second embodiment, on the other hand, a sustain pulse is applied to one of the scan electrode group 19*a* and the sustain electrode group 19*b* while a pulse of the same polarity as the sustain pulse is applied to the other one of the scan electrode group 19*a* and the sustain electrode group 19*b*, and the applied pulses are combined to form the pulses having the above features between the scan electrode group 19*a* and the sustain electrode group 19*b*.

Figure 15:
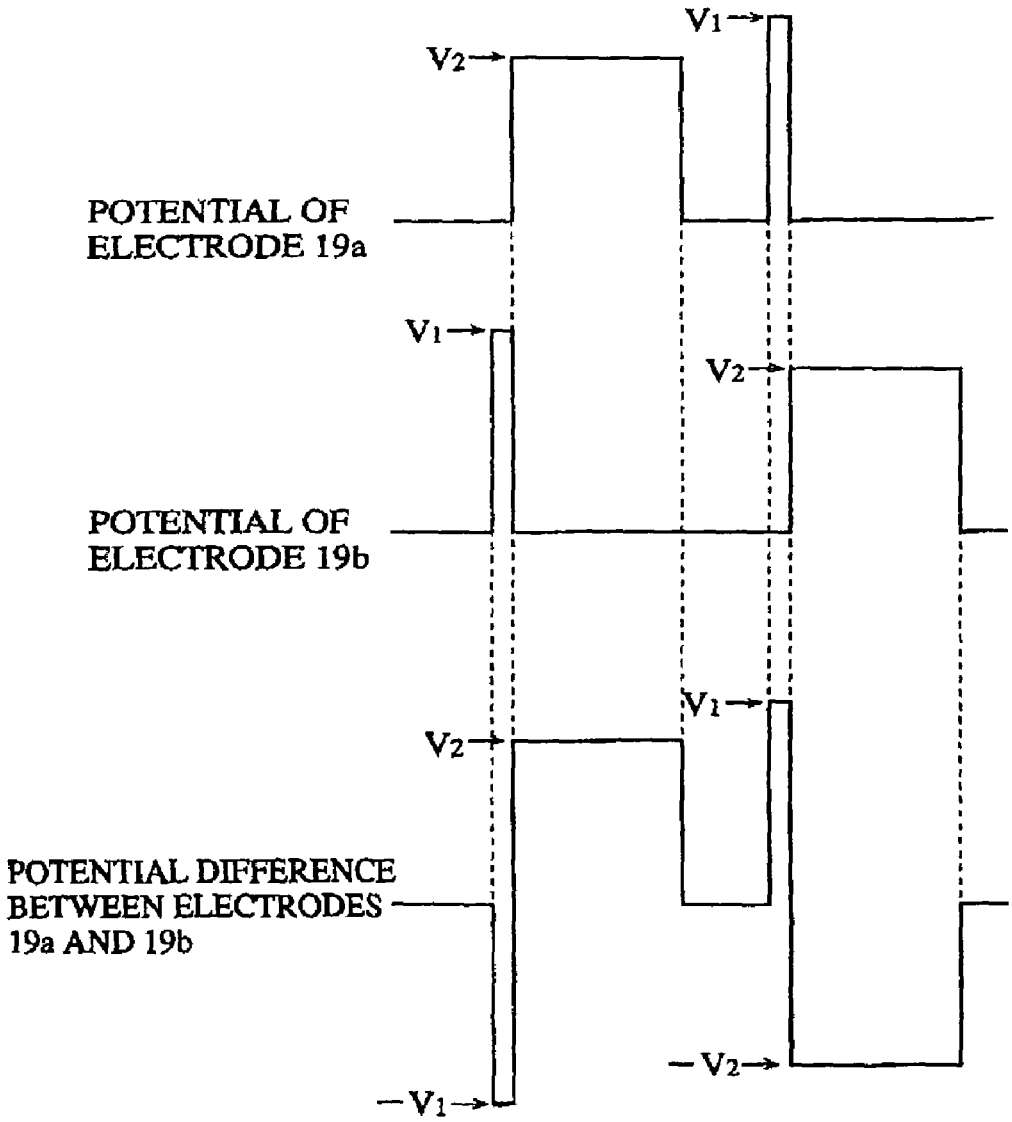
FIG. 15 is a time chart showing the situation when pulses are applied to electrodes in a discharge sustain period, according to the second embodiment of the invention.

FIG. 15 is a time chart showing the situation where the sustain pulse generator 112*a* and the sustain pulse generator 112*b* apply rectangular pulses which oppose in polarity respectively to each scan electrode 19*a* and each sustain electrode 19*b*, and as a result a potential difference is created between each pair of scan electrode 19*a* and sustain electrode 19*b*. The waveform of the potential difference between the scan electrode 19*a* and the sustain electrode 19*b* has the same features as the sustain pulses used in the first embodiment.

In the example in FIG. 15, immediately before a rectangular wave of a positive voltage V2 is applied to the scan electrode 19*a*, a rectangular pulse of a positive voltage V1 is applied briefly to the sustain electrode 19*b*. Then, as soon as the pulse for the sustain electrode 19*b* falls, the rectangular wave of the positive voltage V2 for the scan electrode 19*a* rises. As a result, between the scan electrode 19*a* and the sustain electrode 19*b*, a negative voltage −V1 is applied for a short time immediately before a leading edge of a positive pulse, and after this the sustain pulse of the positive voltage V2 is applied for some time and then falls.

Meanwhile, immediately before a rectangular wave of the positive voltage V2 is applied to the sustain electrode 19*b*, a rectangular pulse of the positive voltage V1 is applied briefly to the scan electrode 19*a*. As soon as the pulse for the scan electrode 19*a* falls, the rectangular wave of the positive voltage V2 for the sustain electrode 19*b* rises. As a result, between the scan electrode 19*a* and the sustain electrode 19*b*, the positive voltage V1 is applied for a short time immediately before a leading edge of a negative pulse, and after this the sustain pulse of the negative voltage −V2 is applied for some time and then falls.

Thus, the pulses applied to the electrodes 19*a* and 19*b* are both rectangular waves in this example, so that there is no need to use such a pulse combining circuit as the one used in the first embodiment.

Third Embodiment

Figure 16:
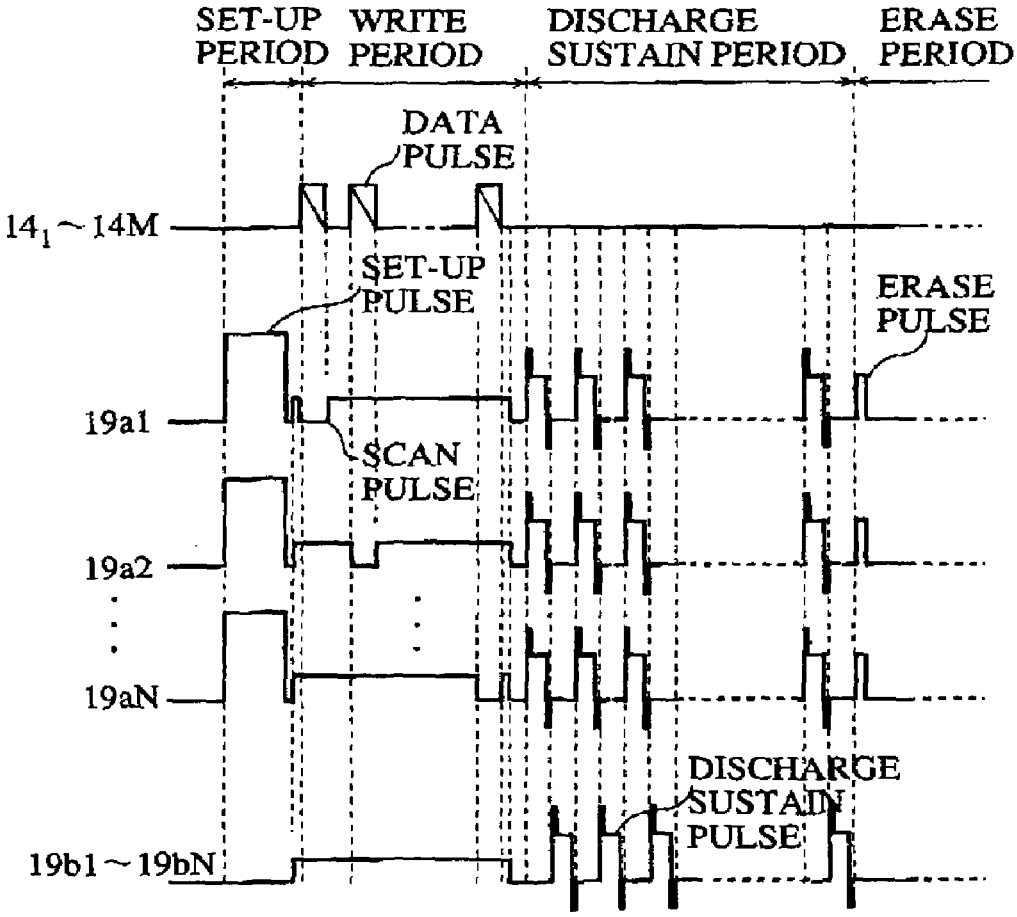
FIG. 16 is a time chart showing when pulses are applied to electrodes, according to the third embodiment of the invention.

In the third embodiment, positive sustain pulses are alternately applied to the scan electrode group 19*a* and the sustain electrode group 19*b* during the discharge sustain period. Here, a voltage of a higher absolute value than normal is applied during a short time immediately after the leading edge of each sustain pulse, and a pulse of the opposite polarity is applied immediately after the trailing edge of each sustain pulse, as shown in FIG. 16.

The following explanation focuses on the case where sustain pulses are applied to the scan electrode group 19*a*. Since the same applies to the case where sustain pulses are applied to the sustain electrode group 19*b*, the explanation for the latter case has been omitted here.

(Effect of the Sustain Pulse Waveform of the Third Embodiment)

Figure 17A:
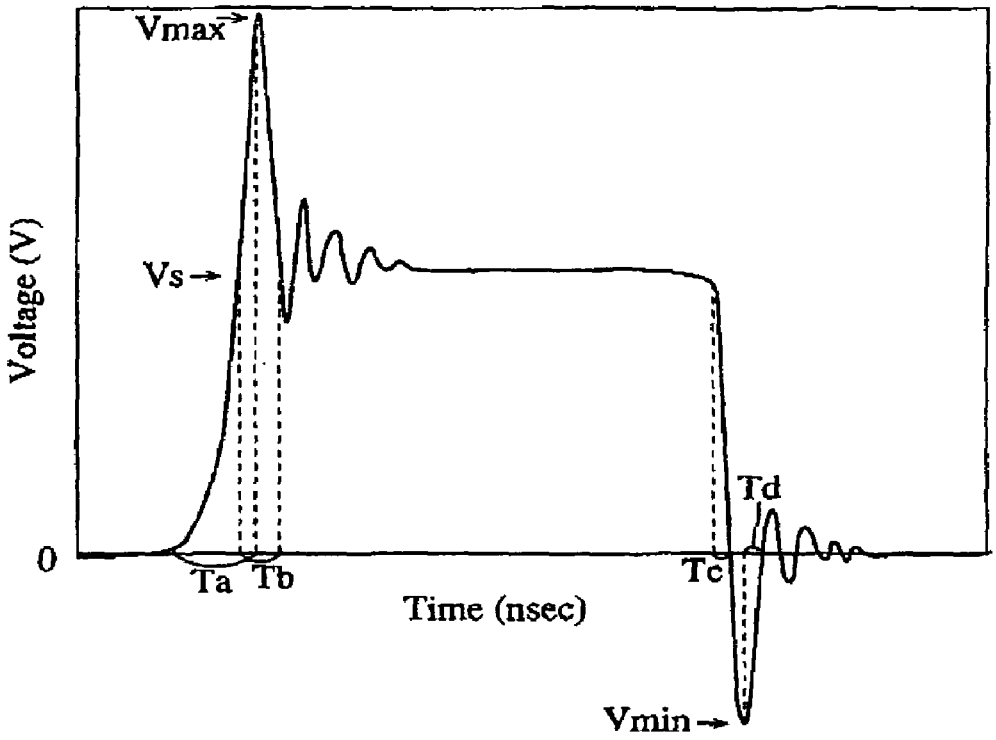
FIG. 17A shows an example of sustain pulse waveform according to the third embodiment.
Figure 17B:
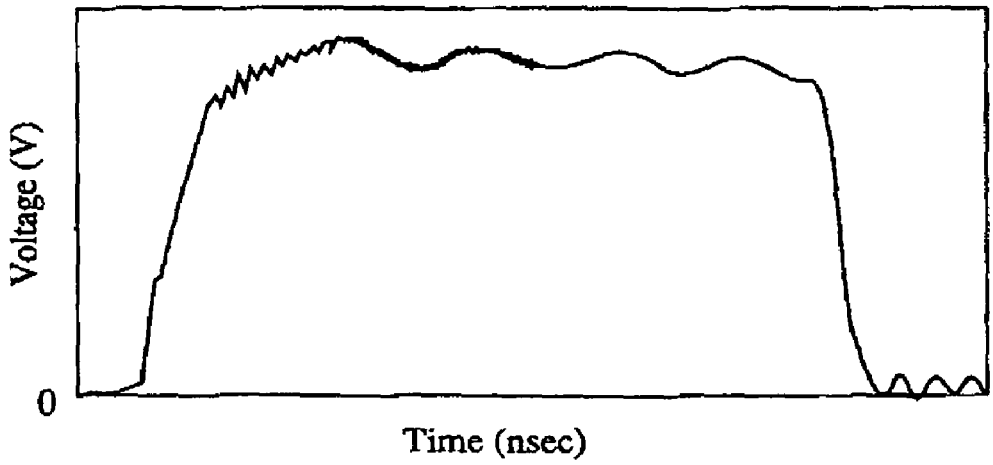
FIG. 17B shows an example of rectangular sustain pulse waveform which is conventionally used.

FIG. 17A shows an example of sustain pulse waveform in this embodiment. The basic part of the positive sustain pulse is a rectangular wave, but the second and third features are added to the sustain pulse. Which is to say, the voltage is higher during a fixed period after the leading edge of the sustain pulse than during a period subsequent to the fixed period (second feature), and a negative pulse is applied immediately after the trailing edge of the sustain pulse (third feature). FIG. 17B shows an example of conventional rectangular sustain pulse waveform.

The second and third features may be added singly. These features each deliver the following effects.

(1) Effect of the Second Feature

When a sustain pulse of a simple rectangular wave shown in FIG. 17B is applied, a discharge delay is likely to occur due to a voltage drop at the leading edge of the sustain pulse. On the other hand, when a higher voltage is applied during a fixed period after the leading edge of the sustain pulse as shown in FIG. 17A, the voltage drop is suppressed, with it being possible to avoid an increase in discharge delay.

Therefore, even when the sustain voltage Vs is set at a relatively low level, the discharge is performed reliably. Which is to say, in spite of the fact that the sustain voltage Vs is fairly lower in the waveform of FIG. 17A than in the waveform of FIG. 17B, the discharge delay will not increase in the case of FIG. 17A, so that a satisfactory image display can be delivered.

In addition, setting the sustain voltage Vs lower has the effect of reducing ion currents and thereby improving luminous efficiency.

To ensure the above effects, it is preferable to set the voltage (maximum voltage Vmax in FIG. 17A) which is applied immediately after the start of the rise time (Ta) of the sustain pulse, to be equal to or greater than the discharge firing voltage in absolute value. Also, it is preferable to se the voltage Vmax higher than the normal sustain voltage Vs by 50V or more.

Also, if the time (Tb) during which the higher voltage is applied is too long, a problem may arise in which a dielectric breakdown occurs in a discharge cell which should not be illuminated and causes a discharge in the discharge cell, or the power consumption increases due to currents flowing during this time. Therefore, the time Tb has to be set short to avoid the dielectric breakdown.

In consideration of these points, the higher the voltage Vmax which is applied immediately after the rise of the sustain pulse, the shorter the application time Tb of the voltage Vmax need be. In general, it is preferable to set the time Tb at 100 ns or below to limit the amount of currents flowing during this time as little as possible. Also, it is more preferable to set the time Tb at 10 ns or below, as the amount of currents flowing during such a time is almost zero.

A more remarkable effect might be obtained if the voltage Vmax applied after the rise of the sustain pulse is very high of around 400V. In this case, however, it is necessary to set the application time Tb of the voltage Vmax extremely short (10–20 ns or below). To do so, circuit performance that enables a sharp rise to such a high voltage is likely to be required.

(2) Effect of the Third Feature

In the sustain pulse waveform of FIG. 17A, the opposite (negative) polarity pulse is briefly applied immediately after the trailing edge of the positive sustain pulse, in addition to the second feature.

Figure 18A:
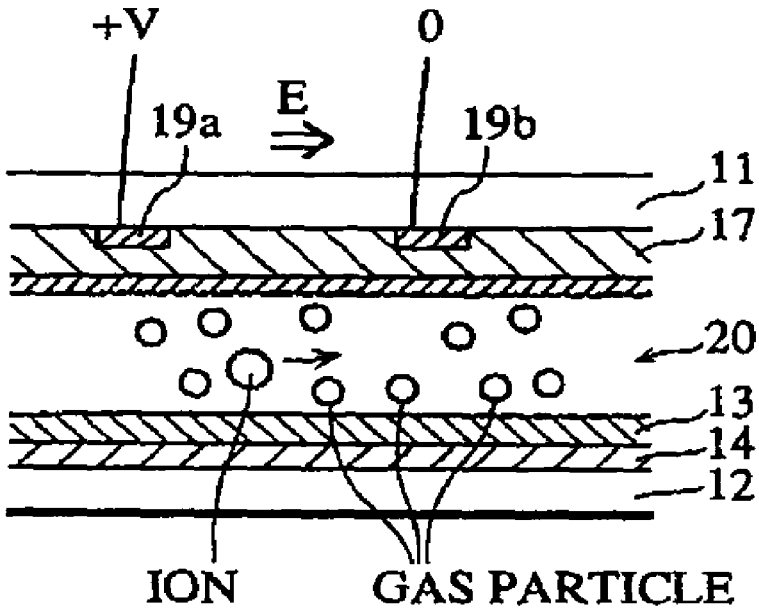
FIGS. 18A and 18B show the movement of current carriers when a sustain pulse is applied.

As shown in FIG. 18A, when the positive sustain pulse is applied to the electrode 19*a*, an electric field E emerges in the discharge space 20 in the direction from the electrode 19*a* to the electrode 19*b*, as a result of which ions which move toward the opposite electrode (the electrode 19*b* in the case of positive ions) are generated in the discharge space 20.

After the sustain pulse falls, the ions which were moving toward the opposite electrode remain. These ions do not much contribute to light emission, so that the ions will become reactive currents if they reach the electrode 19*b*, as noted earlier.

Figure 18B:
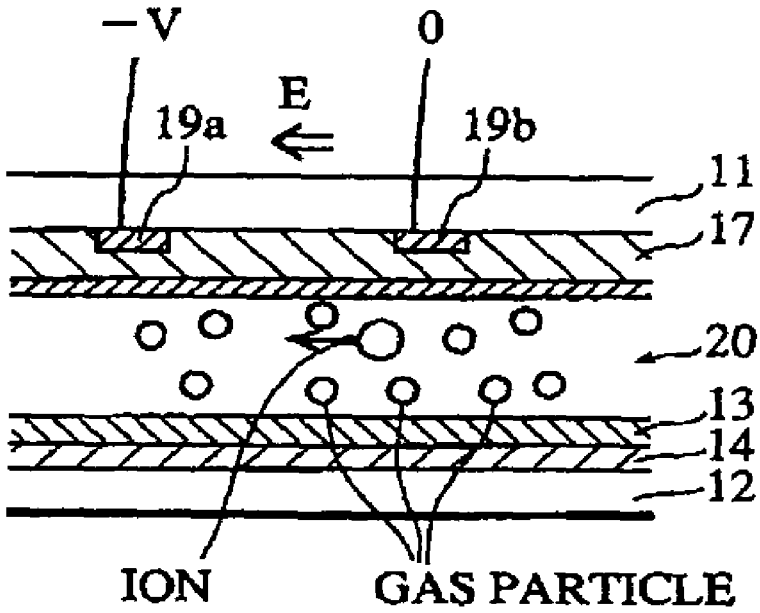

However, if the negative pulse is applied soon after the fall time (Tc in FIG. 17A) of the sustain pulse, an electric field E in the direction from the electrode 19*b* to the electrode 19*a* emerges, as a result of which the ions which were moving toward the electrode 19*b* are pulled back toward the electrode 19*a* without reaching the electrode 19*b*, as shown in FIG. 18B. Thus, the occurrence of reactive currents is suppressed.

Here, it is preferable to set the voltage (Vmin in FIG. 17A) of the opposite (negative) polarity pulse applied soon after the trailing edge of the sustain pulse at 50V or greater in absolute value. Also, the application time of it is preferably 100 ns or shorter, and more preferably 10 ns or shorter.

When only the third feature is added to the sustain pulse, the latter part of the discharge is lost, unlike the conventional rectangular sustain pulse. This may result in a reduction in the amount of wall charge accumulated at the end of discharge. If the amount of wall charge at the end of discharge is small, it would be difficult to start a discharge reliably when the next sustain pulse of the opposite polarity is applied.

Therefore, when only the third feature is added to the sustain pulse, it is desirable to set the sustain voltage Vs higher, in order to ensure a reliable discharge.

(Circuit for Adding the Second and Third Features to the Sustain Pulse)

Figure 19:
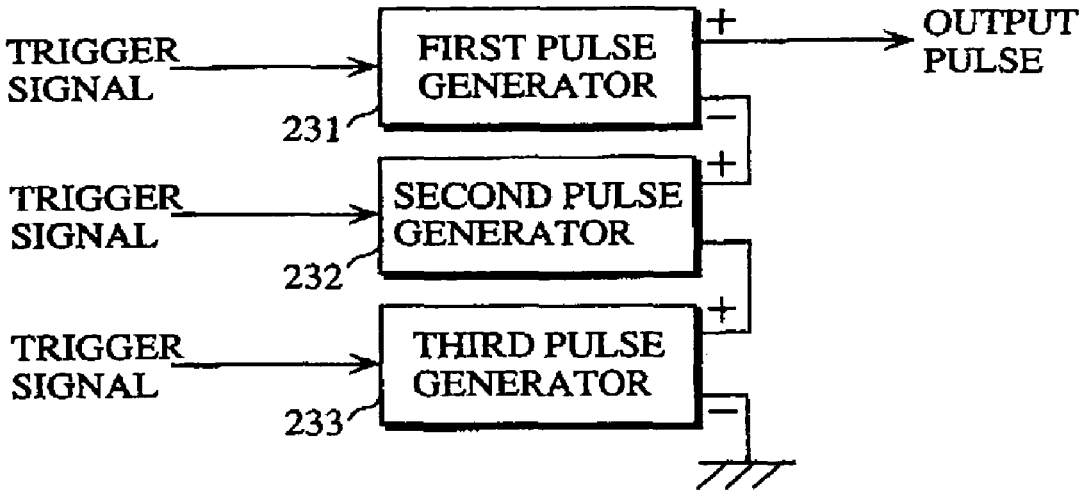
FIG. 19 is a block diagram of a pulse combining Circuit which forms the features of the sustain pulses in the third embodiment.

The above sustain pulse having the second and third features can be applied to the scan electrode group 19*a* and the sustain electrode group 19*b* by providing a pulse combining circuit shown in FIG. 19 in each of the sustain pulse generators 112*a* and 112*b* in FIGS. 5 and 6.

FIG. 19 is a block diagram of a construction of a pulse combining circuit for forming this particular sustain pulse.

This pulse combining circuit is roughly made up of a first pulse generator 231, a second pulse generator 232, and a third pulse generator 233 which generate pulses in response to trigger signals.

The first pulse generator 231 and the second pulse generator 232 generate positive voltage pulses, with the voltage of the pulse generated by the latter being set as the sustain voltage Vs.

A first pulse generated by the first pulse generator 231 is a relatively narrow waver whereas a second pulse generated by the second pulse generator 232 is a relatively wide rectangular wave.

The third pulse generator 233 generates a third pulse of negative voltage which has a narrow width. The timing at which the third pulse rises is set to coincide with the fall of the second pulse.

The pulse generators 231–233 are connected in series using a floating ground method, so that the output voltages of the first to third pulses are added together.

In this pulse combining circuit, the pulse generators 231–233 generate the first to third pulses and combine the generated pulses to an output pulse in response to trigger signals sent from the synchronization pulse generating unit 103, in the following way.

Figure 20:
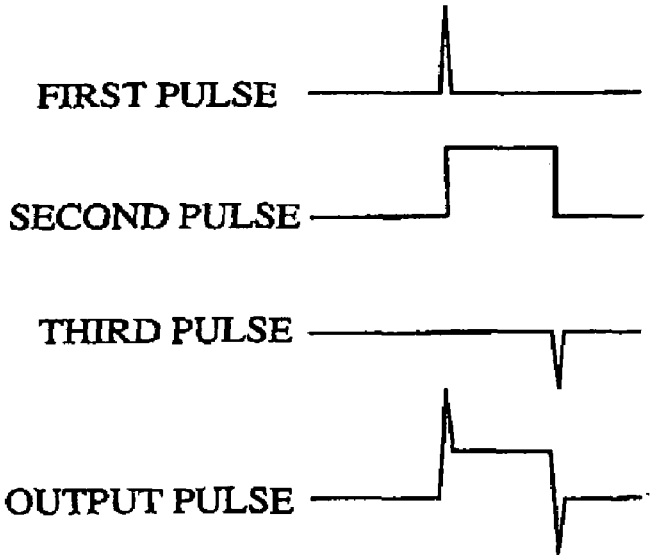
FIG. 20 shows how pulses are combined in the pulse combining circuit shown in FIG. 19.

FIG. 20 shows how the first to third pulses are combined in the pulse combining circuit.

First, the first pulse generator 231 and the second pulse generator 232 receive trigger signals from the synchronization pulse generating unit 103, and have the first and second pulses rise almost simultaneously. Accordingly, a high voltage obtained as a result of adding the voltages of the first and second pulses is outputted.

The first pulse falls soon after the rise, after which only the second pulse is outputted.

Then, simultaneously with the fall of the second pulse, the third pulse generator 233 receives a trigger signal from the synchronization pulse generating unit 103, and has the third pulse of negative voltage rise. Since the third pulse falls soon after the rise, the negative pulse is briefly outputted immediately after the fall of the second pulse.

As a result, the waveform such as the one shown in FIG. 17A is formed.

The pulse combining circuit in FIG. 19 may be modified so that the pulse generators 231–233 are connected in parallel and the largest voltage of the first to third pulses is outputted.

In this case, it is necessary to set the voltage of the first pulse generated by the first pulse generator 231 higher than the voltage of the second pulse by about 50V or more. This requires more sophisticated circuitry, as the first pulse generator 231 has to generate a pulse of an extremely high voltage and a very short width.

(Slope of the Rising Portion of the Sustain Pulse)

When a voltage higher than the normal sustain voltage Vs is briefly applied immediately after the rise of the sustain pulse, the voltage changes more widely than the normal sustain voltage Vs for a short time after the rise. This tends to produce a large amount of currents and thereby decrease luminous efficiency.

Accordingly, to obtain high luminous efficiency, the slope of the rising portion of the sustain pulse may be made gentle in some degree. However, if the slope of part of the rising portion where the voltage exceeds the normal sustain voltage Vs is made gentle, the effect of suppressing discharge delays will be lost.

In consideration of these points, it is preferable that the first half of the rising portion is sloped gently to restrict currents, and the latter half of the rising portion is sloped sharply, as shown in FIG. 17A.

Likewise, it is preferable to set the slope of the falling portion (Td in FIG. 17A) of the opposite polarity pulse applied after the fall of the sustain pulse, to be gentle in some degree so as not to cause a large amount of currents.

The slope during the rise time Ta of the sustain pulse can be adjusted by adjusting the slope of the rising portion of the first pulse or the slopes of the rising portions of both of the first and second pulses. This can be done by adjusting time constants of RLC circuits in the first pulse generator 231 and second pulse generator 232.

The slope during the fall time Td of the opposite polarity pulse can be adjusted by adjusting the slope of the falling portion of the third pulse. This can be done by adjusting a time constant of an RLC circuit in the third pulse generator 233.

(Modifications to the Third Embodiment)

FIG. 17A shows the waveform in which the applied voltage rises higher than the discharge firing voltage quickly in the rise time Ta of the sustain pulse. However, the same effect can be obtained using a waveform in which the voltage first rises to around the normal sustain voltage Vs and then rises to the high voltage after a short interval.

Figure 21:
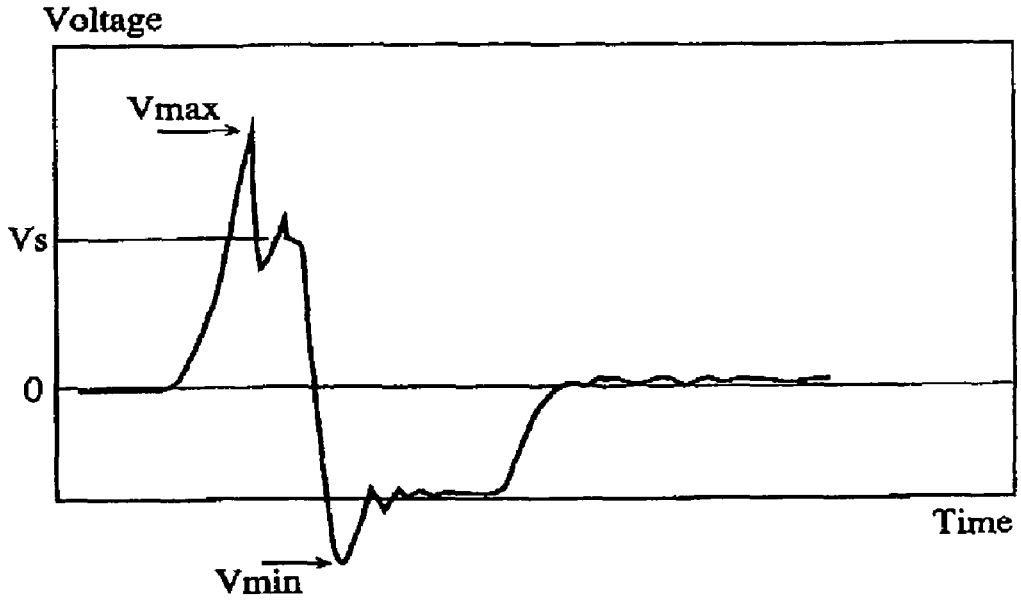
FIG. 21 shows the features of a sustain pulse according to a modification of the third embodiment.

Also, a modification shown in FIG. 21 is applicable.

This modification is the same as the waveform shown in FIG. 17A in that a voltage higher than subsequent voltages is applied for a fixed period after the leading edge of the positive sustain pulse (second feature), and a negative pulse is applied after the trailing edge of the positive sustain pulse (third feature). In FIG. 21, however, the duration of the sustain voltage Vs is very short. Besides, the duration of the negative pulse applied immediately after the trailing edge is long, and the waveform of the negative pulse is different with that shown in FIG. 17A. In this modification, after the trailing edge of the sustain pulse, first a negative voltage Vmin is briefly applied, and then a smaller negative voltage is applied for a relatively long time.

Such a modification has the same effect of improving the luminous efficiency as the third embodiment.

Note here that this kind of waveform may be spontaneously generated when a small-capacity power source (driving circuit) is used, or accidentally generated by a combination of circuits.

Also, though the second and third features are both added to the sustain pulses in the above embodiment, a sufficient effect can be obtained by applying just one of the second and third features.

Fourth Embodiment

In the fourth embodiment, the features of the sustain pulses which are applied across the scan electrode group 19*a* and the sustain electrode group 19*b* in the discharge sustain period are the same as those in the third embodiment.

However, the fourth embodiment differs with the third embodiment in the following point. The third embodiment describes the case where a voltage is not applied to the sustain electrode group 19*b* while a sustain pulse is being applied to the scan electrode group 19*a*, and a voltage is not applied to the scan electrode group 19*a* while a sustain pulse is being applied to the sustain electrode group 19*b*. In the fourth embodiment, on the other hand, pulses are applied to the scan electrode group 19*a* and the sustain electrode group 19*b* at the same time, and the applied pulses are combined to form the pulse waveform with the second and third features between the scan electrode group 19*a* and the sustain electrode group 19*b*.

Figure 22:
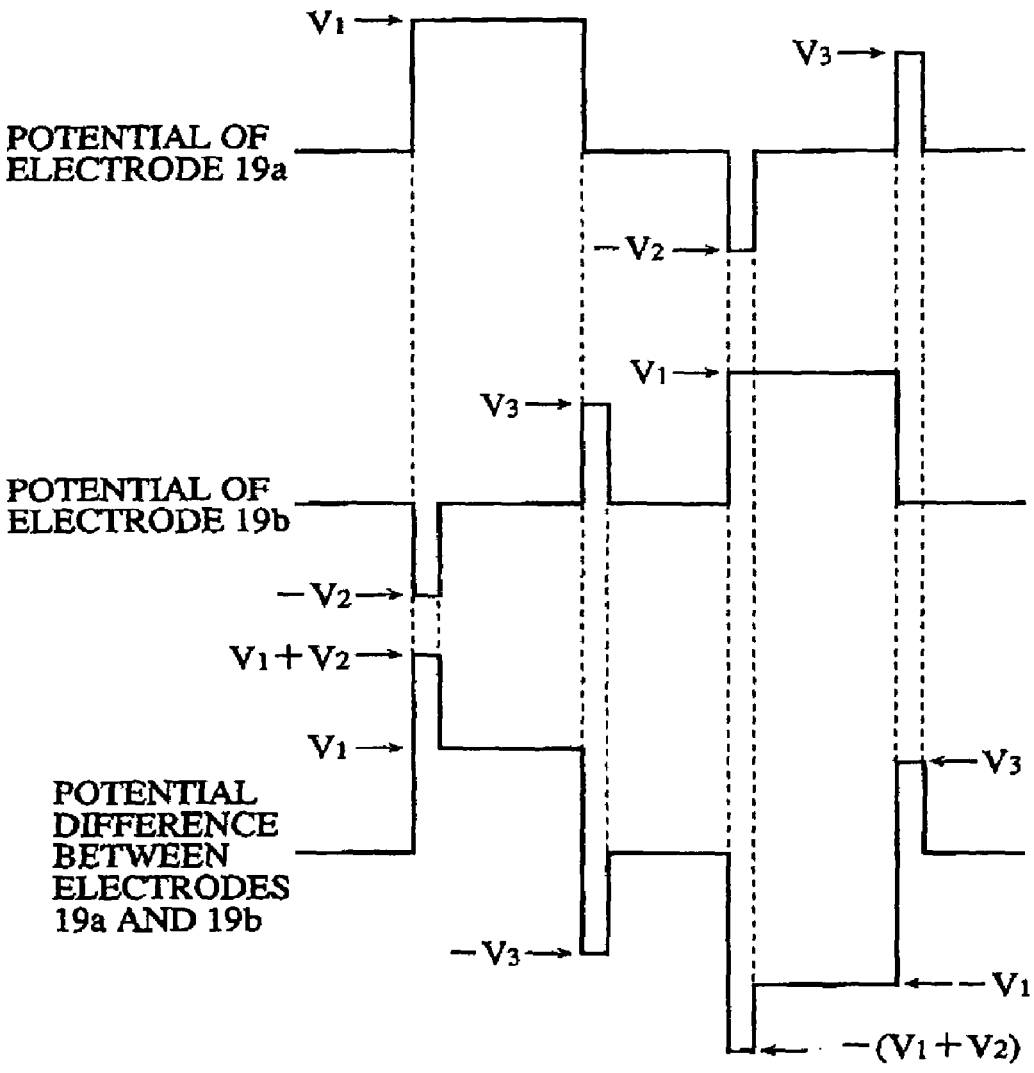
FIG. 22 is a time chart showing an example of applying pulses to electrodes in a discharge sustain period, in the fourth embodiment of the invention.
Figure 23:
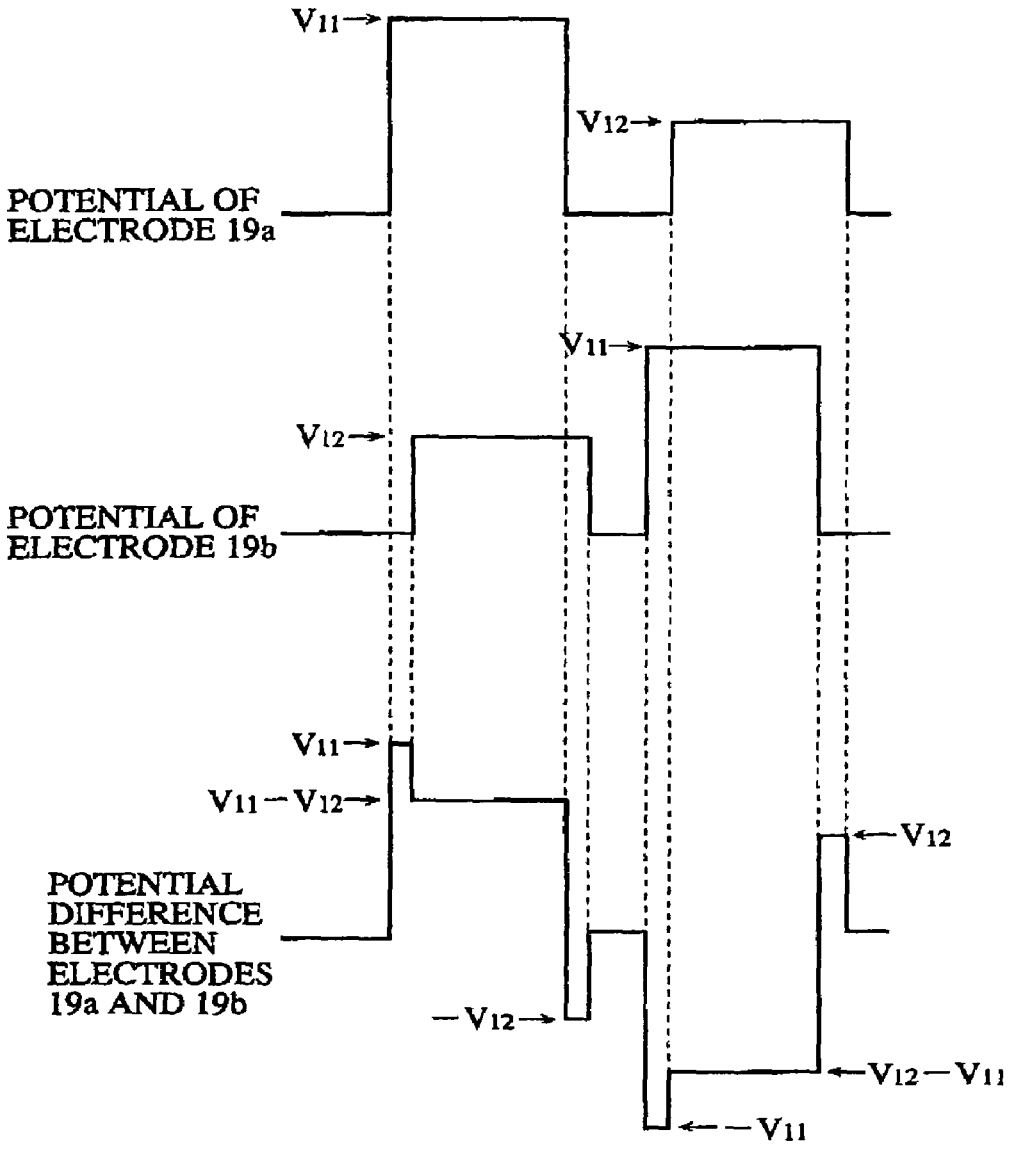
FIG. 23 is a time chart showing an example of applying pulses to electrodes in the discharge sustain period, in the fourth embodiment.
Figure 24:
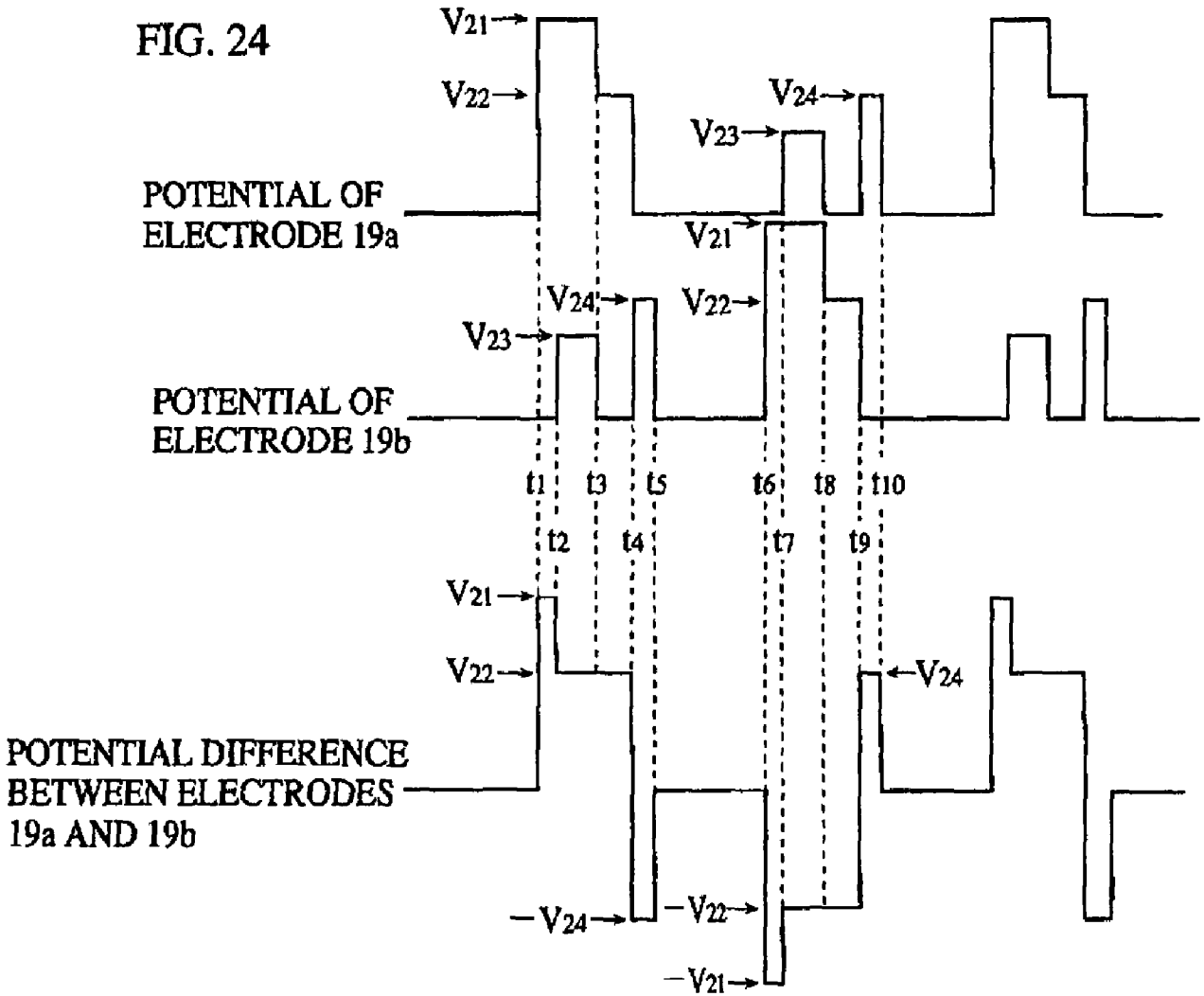
FIG. 24 is a time chart showing an example of applying pulses to electrodes in the discharge sustain period, in the fourth embodiment.
Figure 25:
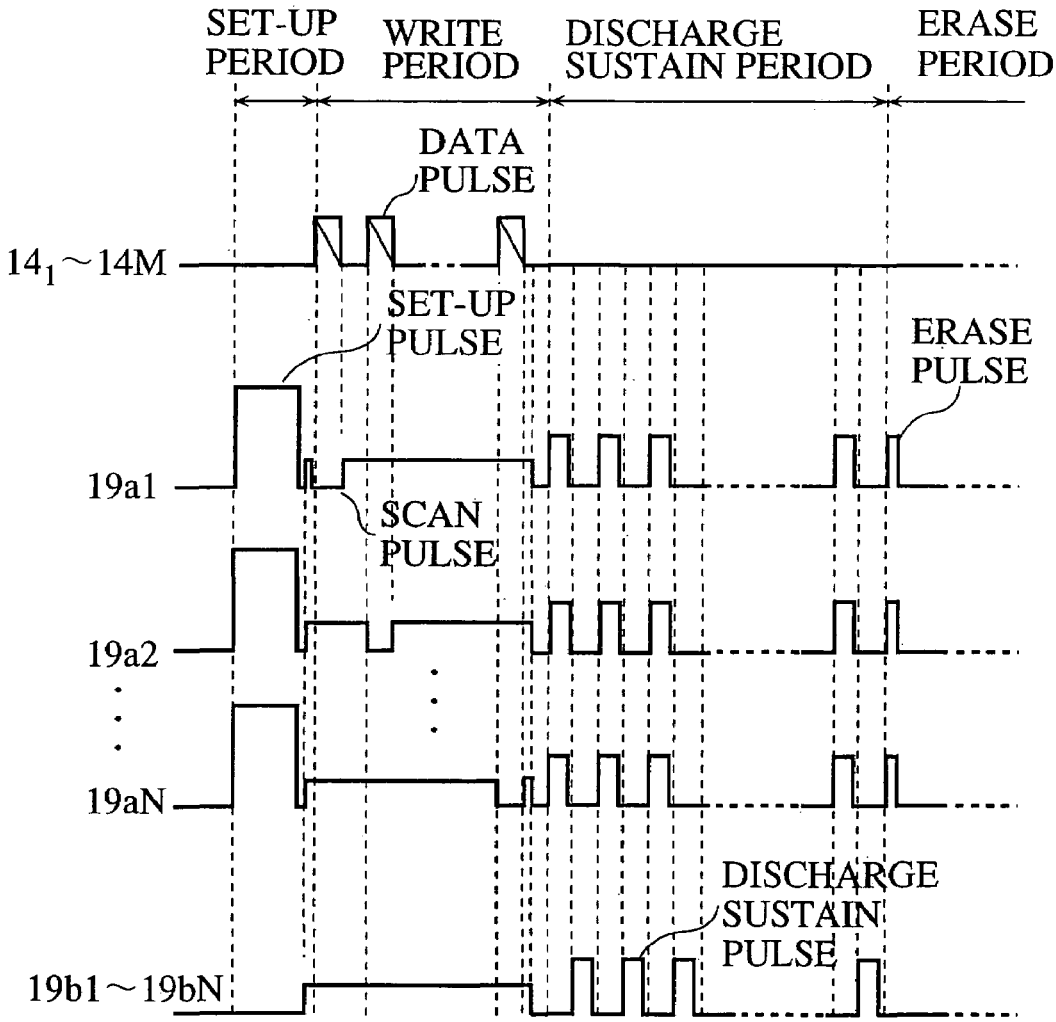
FIG. 25 is a time chart showing when pulses are applied to electrodes in the related art.

Time charts in FIGS. 22–24 each show the case where the sustain pulse generator 112*a* and the sustain pulse generator 112*b* apply pulses which overlap in time, respectively to each scan electrode 19*a* and each sustain electrode 19*b* in the discharge sustain period. Each time chart also shows a potential difference generated between each pair of scan electrode 19*a* and sustain electrode 19*b* as a result of the pulse applications. In each case, the waveform of the potential difference between the scan electrode 19*a* and the sustain electrode 19*b* bears the second and third features, as can be seen from the drawings.

In FIG. 22, at the same time a rectangular pulse of a positive voltage V1 is applied to the scan electrode 19*a*, a short pulse of a negative voltage −V2 whose leading edge almost coincides with the leading edge of the rectangular pulse and a short pulse of a positive voltage V3 whose leading edge almost coincides with the trailing edge of the rectangular pulse are applied to the sustain electrode 19*b*. As a result, between the scan electrode 19*a* and the sustain electrode 19*b*, a high positive voltage V1+V2 is applied for a short time after the rise, and then the positive sustain voltage V1 is applied for some time. Immediately after the sustain voltage V1 falls, a negative pulse −V3 is applied shortly.

Meanwhile, at the same time a rectangular pulse of the positive voltage V1 is applied to the sustain electrode 19*b*, a short pulse of the negative voltage −V2 whose leading edge almost coincides with the leading edge of the rectangular pulse and a short pulse of the positive voltage V3 whose leading edge almost coincides with the trailing edge of the rectangular pulse are applied to the scan electrode 19*a*.

As a result, between the scan electrode 19*a* and the sustain electrode 19*b*, a high negative voltage −(V1+V2) is applied for a short time after the rise, and then a negative sustain voltage −V1 is applied for some time. Immediately after the negative sustain voltage −V1 falls, the positive voltage V3 is applied briefly.

In this example, the pulses which are applied to the electrode 19*a* and 19*b* are both rectangular waves, so that there is no need to use a pulse combining circuit such as the one used in the third embodiment.

In FIG. 23, rectangular pulses of similar widths and different voltages, which overlap in time, are applied to the scan electrode 19*a* and the sustain electrode 19*b*

A pulse of a high voltage V11 (=Vmax) is applied to the scan electrode 19*a*, while a pulse of a low voltage V12 (=Vmax−Vs) is applied to the sustain electrode 19*b* shortly after the leading edge of the pulse of the voltage V11. As a result, between the scan electrode 19*a* and the sustain electrode 19*b*, the high positive voltage V11 is applied for a short time after the rise, and then a positive sustain voltage V11−V12 is applied for some time. Immediately after the positive sustain voltage V11−V12 falls, a negative pulse −V12 is applied briefly.

Following this, a pulse of the high voltage V11 is applied to the sustain electrode 19*b*, while a pulse of .the low voltage V12 is applied to the scan electrode 19*a* shortly after the leading edge of the pulse of the voltage V11 As a result, between the scan electrode 19*a* and the sustain electrode 19*b*, a high negative voltage −V11 is applied for a short time after the rise, and then a negative sustain voltage V12−V11 is applied for some time. Immediately after the negative sustain voltage V12−V11 falls, the positive pulse V12 is applied briefly.

In this example, there is no need for the sustain pulse generators 112*a* and 112*b* to apply narrow pulses, unlike in FIG. 22. Since the sustain pulse generators 112*a* and 112*b* need to only generate relatively wide pulses, circuit performance which enables a sharp rise to a high voltage is not required, with it being possible to reduce the burdens on the circuitry.

In FIG. 24, a pulse of a high positive voltage V21 is applied to the scan electrode 19*a* from point t1 to point t3. This voltage V21 falls at point t3, and a pulse of a positive sustain voltage V22 is applied from point t3 to point t4.

In the meantime, a pulse of a positive voltage V23 is applied to the sustain electrode 19*b* from point t2 which is a little later than point t1, until point t3. Here, V23=V21−V22. Then a narrow pulse of a positive voltage V24 is applied to the sustain electrode 19*b* from point t4 to point t5.

The resulting potential difference between the electrodes 19*a* and 19*b* is as follows. The high positive voltage V21 is applied for a short time (t1 to t2) after the rise, and then the positive sustain voltage V22 (=V21−V23) is applied subsequently (t2 to t4). After the fall of the sustain voltage V22, a negative voltage −V24 is applied briefly (t4 to t5).

From point t6 to point t10, the scan electrode 19*a* and the sustain electrode 19*b* change their places, and the pulses are applied in the same way as above. As a consequence, the same waveform of the opposite polarity is formed between the electrodes 19*a* and 19*b*.

In this example, the application time of the high voltage V21 to each of the electrodes 19*a* and l9*b* is neither short nor long unlike FIG. 23, which allows the burdens on the sustain pulse generators 112*a* and 112*b* to be reduced.

The above example sets V21=V22+V23, so that there is no change in potential difference between the electrodes 19*a* and 19*b* at point t3. However, this is not a limit for the present invention. A similar effect can be accomplished even when the potential difference between the electrodes 19*a* and 19*b* changes lightly at point t3.

Modifications to the First to Fourth Embodiments

The first to fourth embodiments describe the case where the features are added to all sustain pulses in the discharge sustain period. However, when the main purpose is to produce a satisfactory image display, the features do not have to be provided to all sustain pulses in the discharge sustain period but may be limited to part of the sustain pulses.

It should be noted here that when successively applying a plurality of sustain pulses to an electrode in the discharge sustain period, a discharge delay is likely to occur when a sustain pulse is first applied to the electrode. If a discharge by the first sustain pulse is performed with no substantial delay, discharges by the sustain pulses that follow can be performed easily. Accordingly, for a satisfactory image display, the features should be added at least to the first sustain pulse.

One example is that the waveform with the above features is used for the first sustain pulse, and a conventional simple rectangular waveform is used for the sustain pulses that follow.

Another example is that the waveform with the features is used when applying positive sustain pulses to the scan electrode group 19*a*, and the conventional simple rectangular waveform is used when applying positive sustain pulses to the sustain electrode group 19*b*.

In such a case, the effect of improving luminous efficiency is not as high as the case where the features are added to all sustain pulses but the effect of suppressing discharge delays is similar.

Also, the above embodiments take the surface discharge AC PDP as an example, but the invention is also applicable to an opposing discharge PDP with the same effect. In general, the invention can be applied to any panel display apparatus that writes an image by applying write pulses to discharge cells and performs a sustain discharge by applying sustain pulses to the discharge cells, and produce the same effect.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A panel display apparatus comprising:

a gas discharge panel in which a plurality of pairs of first and second electrodes covered with a dielectric are arranged between a pair of substrates; and a driving circuit which accumulates a wall charge on the dielectric to write an image, and successively applies a plurality of sustain pulses to the first electrode and the second electrode to perform a sustain discharge in areas where the wall charge has been accumulated, wherein said driving circuit applies pulses to the first electrode and the second electrode to cause a potential difference between the first electrode and the second electrode generated, wherein said potential difference includes a short pulse being immediately before a leading edge of each sustain pulse and having a predetermined period that is no more than 100 ns, wherein a polarity of the short pulse is opposite to a polarity of the adjacently followed sustain pulse of said potential difference generated between the first electrode and the second electrode and an absolute value of a voltage of the short pulse is no smaller than an absolute value of a voltage of the sustain pulse.

2. The panel display apparatus of claim 1, wherein a time during which the absolute value of the voltage of the short pulse is no smaller than the absolute value of the voltage of the sustain pulse is no more than 50 ns.

3. The panel display apparatus of claim 1, wherein an absolute value of a voltage of the short pulse formed by the driving circuit is no smaller than 1.5 times an absolute value of a voltage of the sustain pulse.

4. The panel display apparatus of claim 1, wherein the driving circuit applies the plurality of sustain pulses alternately to the first electrode and the second electrode, and, immediately before the leading edge of each sustain pulse, applies to the sustain electrode, applies a short pulse of a same polarity as the sustain pulse to the sustain electrode to which the sustain pulse is to be applied, for the predetermined period that is no more than 100 ns; and wherein the sustain pulses are applied to scan electrodes and sustain electrodes alternately.

5. The panel display apparatus of claim 1, wherein the driving circuit applies the plurality of sustain pulses alternately to the first electrode and the second electrode, and, immediately after the falling edge of each sustain pulse applied to the scan electrode, applies a short pulse of a same polarity as the sustain pulse to the scan electrode, for the predetermined period that is no more than 100 ns.

6. The gas discharge panel of claim 1 wherein the short pulse has an absolute voltage that is greater than 150% of the absolute voltage of the sustain pulse.

7. A panel display apparatus comprising:

a gas discharge panel in which a plurality of pairs of first and second electrodes covered with a dielectric are arranged between a pair of substrates; and a driving circuit which accumulates a wall charge on the dielectric to write the image, and successively applies a plurality of sustain pulses to the first electrode and the second electrode to perform a sustain discharge in areas where the wall charge has been accumulated, wherein said driving circuit applies pulses to the first electrode and the second electrode to cause a potential difference between the first electrode and the second electrode generated, wherein said potential difference includes a short pulse applied immediately before a leading edge of each sustain pulse and having a predetermined period that is no more than 100 ns, wherein a polarity of said short pulse is opposite to a polarity of the adjacently followed sustain pulse of each potential difference generated between the first electrode and the second electrode and an absolute value of a voltage of the short pulse is no smaller than an absolute value of a voltage of the sustain pulse.

8. The panel display apparatus of claim 7, wherein a time during which the absolute value of the voltage of the short pulse is no smaller than the absolute value of the voltage of the sustain pulse is no more than 50 ns.

9. A panel display apparatus for displaying an image in a discharge sustain period, comprising:

a gas discharge panel in which a plurality of discharge cells are arranged in the form of matrix between a pair of substrates; and a driving circuit which applies a write pulse to selected discharge cells of the plurality of discharge cells to write the image, and successively applies a plurality of sustain pulses to each of the plurality of discharge cells to perform a sustain discharge in the selected discharge cells, wherein an absolute value of a voltage of each sustain pulse which is applied to the discharge cell is higher during a first period than a second period, the first period being a fixed period from a leading edge of the sustain pulse, and the second period being a period from a lapse of the fixed period to a trailing edge of the sustain pulse, a highest absolute value of the voltage of the sustain pulse in the first period exceeds an absolute value of a discharge firing voltage of the discharge cell, the absolute value of the voltage of the sustain pulse in the second period is below the absolute value of the discharge firing voltage of the discharge cell, and a time during which the absolute value of the voltage of the sustain pulse exceeds the absolute value of the discharge firing voltage is no more than 100 ns.

10. A panel display apparatus for displaying an image in a discharge sustain period, comprising:

a gas discharge panel in which a plurality of discharge cells are arranged in the form of matrix between a pair of substrates; and a driving circuit which applies a write pulse to selected discharge cells of the plurality of discharge cells to write the image, and successively applies a plurality of Sustain pulses to each of the plurality of discharge cells to perform a sustain discharge in the selected discharge cells, wherein an absolute value of a voltage of each sustain pulse which is applied to the discharge cell is higher during a first period than a second period, the first period being a fixed period from a leading edge of the sustain pulse, and the second period being a period from a lapse of the fixed period to a trailing edge of the sustain pulse, and immediately after the trailing edge of the sustain pulse, the driving circuit applies a pulse that is opposite in polarity to the sustain pulse, to the discharge cell for a predetermined period that is no more than 100 ns.

11. A panel display apparatus comprising:

a gas discharge panel in which a plurality of pairs of first and second electrodes covered with a dielectric are arranged between a pair of substrates; and a driving circuit which accumulates a wall charge on the dielectric to write an image, and successively applies a plurality of sustain pulses to the first electrode and the second electrode to perform a sustain discharge in areas where the wall charge has been accumulated, wherein said driving circuit applies pulses to the first electrode and the second electrode to cause a potential difference between the first electrode and the second electrode generated, wherein said potential difference includes a short pulse being immediately after a trailing edge of each sustain pulse and having a predetermined period that is no more than 100 ns, wherein a polarity of the short pulse is opposite to a polarity of the adjacently followed sustain pulse of said potential difference generated between the first electrode and the second electrode and an absolute value of a voltage of the short pulse is no smaller than an absolute value of a voltage of the sustain pulse.

12. A driving method for displaying an image in a discharge sustain period in a gas discharge panel in which a plurality of pairs of first and second electrodes covered with a dielectric are arranged between a pair of substrates, comprising:

a writing step for accumulating a wall charge on the dielectric to write the image; and a discharge sustaining step for successively applying a plurality of sustain pulses to the first electrode and the second electrode to perform a sustain discharge areas where the wall charge has been accumulated, wherein said driving circuit applies pulses to the first electrode and the second electrode to cause a potential difference between the first electrode and the second electrode generated, wherein in the discharge sustaining step, said potential difference includes a short pulse being immediately before a leading edge of each sustain pulse and having a predetermined period that is no more than 100 ns, wherein a polarity said short pulse is opposite to a polarity of the adjacently followed sustain pulse of said potential difference generated between the first electrode and the second electrode and an absolute value of a voltage of the short pulse is no smaller than an absolute value of a voltage of the sustain pulse.

13. A driving method for displaying an image in a discharge sustain period in a gas discharge panel in which a plurality of discharge cells are arranged between a pair of substrates, comprising:

a writing step for applying a write pulse to selected discharge cells of the plurality of discharge cells to write the image; and a discharge sustaining step for successively applying a plurality of sustain pulses to each of the plurality of discharge cells to perform a sustain discharge in the selected discharge cells, wherein in the discharge sustaining step, an absolute value of a voltage of each sustain pulse which is applied to the discharge cell is higher during a first period than a second period, the first period being a fixed period from a leading edge of the sustain pulse, and the second period being a period from a lapse of the fixed period to a trailing edge of the sustain pulse, and a time during which the absolute value of the voltage of the sustain pulse exceeds an absolute value of a discharge firing voltage of the discharge cell is no more than 100 ns.

14. A driving method for displaying an image in a discharge sustain period in a gas discharge panel in which a plurality of pairs of sustain and scan electrodes covered with a dielectric are arranged between a pair of substrates, comprising:

a writing step for accumulating a wall charge on the dielectric to write the image; and a discharge sustaining step for successively applying a plurality of sustain pulses to the sustain electrode and the scan electrode to perform a sustain discharge in areas where the wall charge has been accumulated, wherein in the discharge sustaining step, said driving circuit applies pulses to the sustain electrode and the scan electrode to cause a potential difference between the sustain electrode and the scan electrode generated, wherein said potential difference includes a short pulse being immediately before a trailing edge of each sustain pulse and having a predetermined period that is no more than 100 ns, wherein a polarity of said short pulse is opposite to a polarity of the adjacently followed sustain pulse of said potential difference generated between the sustain electrode and the scan electrode, and an absolute value of a voltage of the short pulse is no smaller than an absolute value of a voltage of the sustain pulse.

15. A gas discharge panel comprising:

a plurality of discharge cells having a front substrate and a back substrate;

a plurality of scan electrodes running between the front substrate and the back substrate;

a plurality of sustain electrodes parallel to the plurality of scan electrodes; and a drive circuit for generating an alternating sustain waveform between the scan electrodes and the sustain electrodes;

wherein said driving circuit applies pulses to the sustain electrode and the scan electrode to cause a potential difference between the sustain electrode and the scan electrode generated, wherein said potential difference includes a short pulse being immediately before a leading edge of each sustain pulse and having a predetermined period that is no more than 100 ns, and wherein a polarity of said short pulse is opposite to a polarity of the adjacently followed sustain pulse of said potential difference generated between the sustain electrode and the scan electrode; and an absolute value of a voltage of the short pulse is no smaller than an absolute value of a voltage of the sustain pulse.

* * * * *

UNITED STATES PATENT AND TRADEMARK OFFICE

CERTIFICATE OF CORRECTION

PATENT NO. : 7,176,851 B2
APPLICATION NO. : 09/805529
DATED : February 13, 2007
INVENTOR(S) : Shiokawa et al.

It is certified that error appears in the above-identified patent and that said Letters Patent is hereby corrected as shown below:

In Claim 10, Column 22, line 33, "Sustain" should be a lower case "s" --sustain--.
In Claim 14, Column 24, lines 10 and 11-14 should be part of the same paragraph.

Signed and Sealed this

Tenth Day of April, 2007

JON W. DUDAS
*Director of the United States Patent and Trademark Office*